US008948677B2

(12) United States Patent
Kabata et al.

(10) Patent No.: US 8,948,677 B2
(45) Date of Patent: Feb. 3, 2015

(54) PROTECTIVE AGENT BLOCK, METHOD OF MANUFACTURING THE SAME, PROCESS CARTRIDGE, AND IMAGE FORMING APPARATUS

(75) Inventors: Toshiyuki Kabata, Kanagawa (JP); Momoko Shionoiri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 132 days.

(21) Appl. No.: 13/489,629

(22) Filed: Jun. 6, 2012

(65) Prior Publication Data

US 2012/0308260 A1 Dec. 6, 2012

(30) Foreign Application Priority Data

Jun. 6, 2011 (JP) ..... 2011-126370
May 9, 2012 (JP) ..... 2012-107653

(51) Int. Cl.
*G03G 21/00* (2006.01)
*C10M 141/12* (2006.01)

(52) U.S. Cl.
CPC ..... *G03G 21/0094* (2013.01); *C10M 141/12* (2013.01); *G03G 2221/183* (2013.01); *C10M 2201/062* (2013.01); *C10M 2201/087* (2013.01); *C10M 2207/126* (2013.01); *C10N 2220/082* (2013.01); *C10N 2230/06* (2013.01); *C10N 2240/203* (2013.01); *C10N 2250/08* (2013.01)
USPC ..... 399/346; 508/100

(58) Field of Classification Search
CPC ..... G03G 21/0094; G03G 2221/1633; C10M 141/12; C10M 2201/087
USPC ..... 399/346, 343; 508/100
See application file for complete search history.

(56) References Cited

U.S. PATENT DOCUMENTS

| | | | | |
|---|---|---|---|---|
| 7,991,342 | B2 | 8/2011 | Kabata et al. | |
| 8,242,061 | B2 * | 8/2012 | Sugiura et al. | |
| 2005/0196194 | A1 * | 9/2005 | Suda et al. | |
| 2010/0310291 | A1 * | 12/2010 | Tanaka et al. | 399/346 |
| 2011/0085824 | A1 * | 4/2011 | Hatakeyama et al. | 399/346 |

FOREIGN PATENT DOCUMENTS

| | | |
|---|---|---|
| JP | 2004-279788 | 10/2004 |
| JP | 2008-134467 | 6/2008 |
| JP | 2010-26461 | 2/2010 |

* cited by examiner

*Primary Examiner* — Susan Lee
(74) *Attorney, Agent, or Firm* — Oblon, Spivak, McClelland, Maier & Neustadt, L.L.P.

(57) ABSTRACT

A protective agent block including metal soap; and boron nitride, wherein the weight ratio Mr of boron nitride to the metal soap is calculated from the relationship 1 based on Raman spectrum measured at each of multiple places on the protective agent block and the average of the measured weight ratios Mr ranges from 0.050 to 0.330 with a variation coefficient of 0.075 or less:

$$Mr=(\log(ABN/ASP)+1.3588)/7.7374 \quad \text{Relationship 1}$$

where ABN represents a peak area in a range of from a wavenumber of 1377.837 $cm^{-1}$ to 1354.695 $cm^{-1}$ and ASP represents a peak area in a range of from a wavenumber of 1481.012 $cm^{-1}$ to 1420.264 $cm^{-1}$.

8 Claims, 6 Drawing Sheets

PROTECTIVE AGENT BLOCK, METHOD OF MANUFACTURING THE SAME, PROCESS CARTRIDGE, AND IMAGE FORMING APPARATUS

CROSS-REFERENCE TO RELATED APPLICATION

This patent application is based on and claims priority pursuant to 35 U.S.C. §119 to Japanese Patent Application Nos. 2011-126370 and 2012-107653, filed on Jun. 6, 2011 and May 9, 2012, respectively, the entire disclosures of which are hereby incorporated by reference herein.

BACKGROUND OF THE INVENTION

1. Field of the Invention

The present invention relates to a protective agent block for use in a protective agent applicator, a method of manufacturing the protective agent, a process cartridge, and an image forming apparatus.

2. Description of the Background

In the image forming apparatus employing electrophotography, images are formed on recording media, etc. by processes of charging, irradiation, development, transfer etc. applied to an image bearing member. A minute amount of corona products produced in the charging process and/or residual toner remaining after the transfer process are attached to the surface of the image bearing member until they are removed by the cleaning process after the transfer process. Thereafter, the image forming starting from the charging process is conducted again on the image bearing member.

A cleaning system having a rubber blade is typically used in the cleaning process because such a rubber blade has a simple and cost-saving mechanism with a good cleaning performance. However, since the rubber blade is pressed against the image bearing member to remove the attached material on the surface thereof, the rubber blade and the image bearing member are under a large mechanical stress caused by friction between the surface of the image bearing member and the rubber blade. This easily leads to attrition of the rubber blade and the surface layer of the image bearing member, which shortens the working lives of the rubber blade and the image bearing member. This attrition is significant particularly on the surface layer of an organic photoconductor.

On the other hand, the toner for use in forming images is reduced in size to deal with the demand for improvement on the image quality. In the case of an image forming apparatus using a toner having a small particle diameter, the ratio of residual toner that slips through the edge portion of the cleaning blade and the surface of the image bearing member tends to increase. This is particularly true when the dimension accuracy and/or assembly accuracy is not sufficient or the cleaning blade partially vibrates, which prevents formation of quality images.

Therefore, reducing the deterioration of the image bearing member and the cleaning blade caused by abrasion and improving the cleaning property of the surface of the image bearing member are demanded to prolong the working life of the image bearing member and maintain the quality of images over a long period of time.

To meet this demand, Japanese Patent Application Publication No. 2004-279788 (JPAP-2004-279788-A) describes a method in which a brush, etc. is pressed against a block of metal soap formed of zinc stearate, etc., to obtain fine powder of the metal soap, which is supplied to an image bearing member to form a film of a lubricant thereon by a cleaning blade.

The metal soap formed of zinc stearate, etc. improves the lubrication property of the surface of the image bearing member and reduces the abrasion between the image bearing member and the cleaning blade. In addition, the cleaning property of the residual toner is improved. Therefore, using such metal soap is extremely preferred.

In addition, color image forming apparatuses have been widely used in recent years, which leads to an increasing demand for the quality of images. Thus, the current dominant charging system uses an AC charging system which applies an AC voltage overlapped with a DC voltage to the surface of the image bearing member using a charging roller as a charger. Furthermore, since the AC charging system using a charging roller satisfies the need for size reduction and produces a less amount of oxidized gases such as ozone and NOx, there is a great need for the AC charging system. However, in the AC charging system, the image bearing member is repetitively charged positively and negatively several hundreds to several thousands of times per second depending on frequency. Thus, the image bearing member is easily and heavily damaged in comparison with a DC charging system, in which an image bearing member is positively charged only once while the image bearing member passes through the charging device. Therefore, damage to the image bearing member in the AC charging system accumulate by far sooner than in the DC charging system so that protecting the image bearing member from the damage is demanded for the AC charging system. The metal soap improves the lubricity of the surface of the image bearing member and receives the hazard by AC charging, thereby protecting the image bearing member. Therefore, a large amount of metal soap tends to be applied.

Metal soap is generally of a block form and supplied to the image bearing member in a form of particulates produced when the metal soap is rubbed by a brush pressed against the metal soap. The metal soap supplied to the image bearing member is crushed by the blade and forms a protection layer of the metal soap.

However, if the brush is strongly pressed against the block of metal soap to increase the application amount thereof, large particles of the metal soap tend to be produced and supplied to the image bearing member. Such large particles easily slip through the cleaning blade and cause non-uniform application on the surface of the image bearing member.

In addition, toner and lubricants such as the metal soap that have slipped through the cleaning blade scatter to and fixate on the charging roller, thereby increasing the electric resistance of the charging roller, resulting in bad charging performance. Therefore, protecting the charging roller from contamination is another issue Typically, the working life of an image bearing member is prolonged but a charging roller and a cleaning blade tend to be replaced when they deteriorate. However, in terms of concerns for the environment, there is a strong need for prolongation of the working life of each member of the charging roller, the cleaning blade, the image bearing member, etc. Therefore, technologies are demanded to prevent deterioration of and contamination on each member.

In an attempt to deal with the issue that the powder of the metal soap supplied to the image bearing member passes through the cleaning blade and scatters to and fixates on the charging roller, which leads to a bad charging performance, JPAP-2008-134467-A describes a protective agent in which boron nitride is blended in metal soap. In JPAP-2008-134467-A mentioned above, it is reported that scattering of the metal soap to the charging roller and abrasion of the cleaning blade are lessened for an extended period of time by blending boron nitride with metal soap (zinc stearate) so that blending an inorganic lubricant of boron nitride with metal soap is effective. In addition, it is possible to simply replace a block of typically-used zinc stearate with this blended lubricant.

The protective agent block of the metal soap is manufactured by heating the metal soap to a temperature higher than the melting point thereof followed by cooling down. On the other hand, the protective agent in which boron nitride is blended in the metal soap is manufactured by mixing and compacting powder of boron nitride and powder of the metal soap as described in JPAP-2010-26461-A. By using the protective agent block manufactured by this method, quality images can be produced.

However, when the thickness of the protective agent block is increased, for example, 15 mm or more to protect the image bearing member for an extended period of time, thereby reducing the frequency of exchanging the image bearing member, the powder of boron nitride and the powder of the protective agent block tend to be not homogenized in the protective agent block and the protective agent block is deformed in severe cases. Alternatively, even though the form of the protective agent block is normal, defective images having black streaks or image blurring may be produced as image forming is repeated. Such defective images greatly vary depending on the manufacturing lot.

Since the powder of the metal soap and boron nitride are generally significantly different with regard to the particle size and the density, it is difficult to uniformly disperse boron nitride in the protective agent. If the block has a portion containing an extremely small amount of boron nitride, the charging roller is easily contaminated partially, thereby increasing the electric resistance of that portion, where the charging performance deteriorates, resulting in production of defective images having streaks. By contrast, if the block has a portion containing an extremely large amount of boron nitride, boron nitride tends to accumulate on the image bearing member and the metal soap and silica serving as an external additive furthermore accumulate, which increases the possibility of production of defective images.

Moreover, since the metal soap and boron nitride for use in the protective agent block are fine powder, when the powder is placed and molded in a mold (cast), particles of the metal soap and boron nitride tend to leak from gaps in the mold. In addition, since the volume when the metal soap and boron nitride are compacted changes greatly from the volume when the metal soap and boron nitride are placed in the mold, it is necessary to compact the powder while removing air between each particle. However, when the thickness of the compacted protective agent block is too thick, for example 15 mm or more, the air between each particle is not be able to be removed so that the density of the compacted protective agent is locally different. Moreover, when the thickness of the compacted protective agent block is too thick, the rate of the particles of the protective agent that have leaked from the mold tends to increase. Therefore, the rate of the metal soap and boron nitride tends to significantly change locally or the density of the protective agent block tends to change. If the rate of the metal soap and boron nitride is different locally, the amount of the protective agent scraped by the brush pressed thereagainst changes from place to place so that protection of the image bearing member decreases at portions where the amount of the protective agent scraped by the brush is small, resulting in production of defective images having streaks.

In addition, soft portions in the protective agent block are scraped sooner. Since the abrasion speed of the image bearing member is drastically different between when the protective agent is supplied to the image bearing member and when the protective agent is not supplied to the image bearing member, no matter how much hard portions remain in the protective agent block, defective images are produced when a portion where the protective agent has exhausted is formed.

In particular, in an environment in low temperatures, when the density of the protective agent block is not uniform therein, how the protective agent block is scraped and the amount of the protective agent supplied to the image bearing member tend to be locally dependent, The accuracy of molding is improved by increasing the size of the particles of boron nitride and the metal soap. However, if the protective agent block is manufactured by using boron nitride and the metal soap having large particle diameters, the protective agent scraped by abrasion between the brush and the protective agent block has a large particle diameter. Therefore, application of the protective agent to the surface of the image bearing member tends to be non-uniform and particles of the protective agent that pass through the blade tend to increase in number and attach to the charging roller, resulting in production of defective images with streaks. In addition, boron nitride tends to accumulate on the image bearing member and the metal soap and silica serving as an external additive to the metal soap and toner furthermore accumulate, which creates a problem of production of defective images.

SUMMARY OF THE INVENTION

In view of the foregoing, the present invention provides a protective agent block containing metal soap and boron nitride, wherein the weight ratio Mr of boron nitride to the metal soap is calculated from the relationship 1 based on Raman spectrum measured at each of multiple places on the protective agent block and an average of the measured weight ratios Mr ranges from 0.050 to 0.330 with a variation coefficient of 0.075 or less.

$$Mr=(\log(ABN/ASP)+1.3588)/7.7374 \qquad \text{Relationship 1.}$$

In the Relationship 1, ABN represents a peak area in a range of from a wavenumber of 1377.837 $cm^{-1}$ to 1354.695 $cm^{-1}$ and ASP represents a peak area in a range of from a wavenumber of 1481.012 $cm^{-1}$ to 1420.264 $cm^{-1}$.

As another aspect of the present invention, a protective agent block is provided which is manufactured by a method of particulating a mixture containing metal soap and boron nitride to obtain protective agent particles having an average particle diameter of from 30 μm to 300 μm containing the metal soap and boron nitride and compacting the protective agent particles to obtain the protective agent block.

As another aspect of the present invention, a method of manufacturing a protective agent is provided which includes particulating a mixture containing powder of metal soap and powder of boron nitride to obtain protective agent particles having an average particle diameter of from 30 μm to 300 μm which contain the metal soap and boron nitride, and compacting the protective agent particles to obtain the protective agent block.

As another aspect of the present invention, a process cartridge is provided which includes a process agent application applicator having the protective agent block mentioned above.

As another aspect of the present invention, an image forming apparatus is provided which includes a process agent application applicator having the protective agent block mentioned above.

As another aspect of the present invention, an image forming apparatus is provided which includes multiple image forming stations to form a color image by superimposing multiple color images, wherein one of the multiple image forming stations includes a process agent application applicator having the protective agent block mentioned above

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
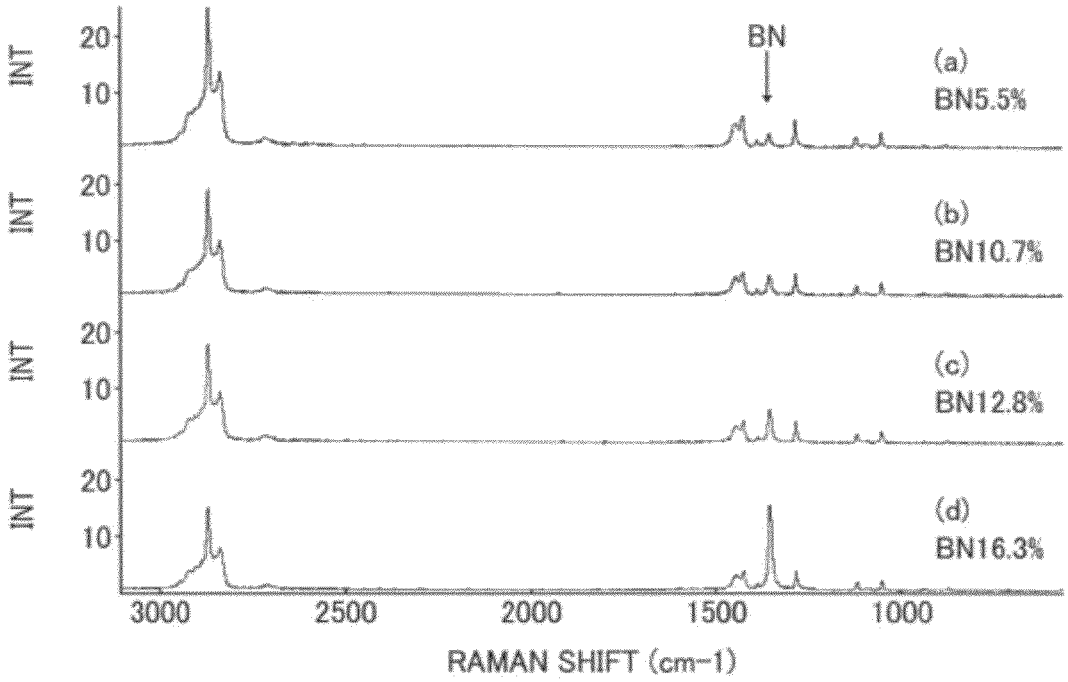
FIG. 1 is graphs illustrating Raman spectra of mixtures in which boron nitride is added to zinc stearate.

The present inventors thought that since a thin and good protective agent block mainly formed of metal soap and boron nitride can be manufactured, a thick and good protective agent block can be manufactured by firstly manufacturing a thin protective agent block and forming another protective agent block on the thin protective agent block. However, the manufactured thick protective agent block has a tendency to crack at the interface between the firstly manufactured protective agent block and the protective agent block formed thereon. In addition, although such a laminate protective agent block tends not to crack at each interface as the thickness of the protective agent block becomes thin, it takes a longer time to manufacture the protective agent block, thereby increasing the manufacturing cost.

The present inventors pulverized the thinly-manufactured protective agent block, investigated pulverized particles, and found that the pulverized particles were by far larger than the particles before manufacturing but the metal soap and boron nitride were integrated in the pulverized particles, meaning that boron nitride is not particularly detached. The present inventors manufactured a protective agent block having a thickness of 15 mm or greater by placing the pulverized particles into a cast for manufacturing protective agent blocks, assembled the protective agent block into an image forming apparatus, and forming images thereby to find that quality images were produced for an extended period of time. Furthermore, when this protective agent and a protective agent block causing production of defective images with streaks were investigated, it was found that the block agent causing defective images with streaks had a boron nitride distribution variable in the longitudinal direction.

In addition, the present inventors investigated whether the distribution measuring (quantitative measuring of the weight ratio of metal soap to boron nitride) of boron nitride by Raman spectroscopic analysis. Quantitative measuring of the weight ratio of metal soap to boron nitride can be analyzed by ICP emission spectrochemical analysis, XP(X-ray photoemission spectroscopy) analysis, IR (infra-red) analysis, fluorescent X-ray analysis, Raman spectroscopic analysis, etc. Among these, Raman spectroscopic analysis is most preferable in terms of simplicity and reproducibility of measuring. Since boron nitride is formed of light-weight elements, quantification by element analysis is not suitable. In addition, samples can be non-destructively measured by Raman spectroscopic analysis. If a space is secured to place a protective agent block in a sample room, the ratio of boron nitride to metal soap in the protective agent can be obtained.

As a result of the investigation, it was found that, by Raman spectroscopic analysis, since boron nitride had an extremely sharp peak between 1.387 $cm^{-1}$ and 1.341 $cm^{-1}$, the ratio (weight ratio in this case) of boron nitride to metal soap could be quantitatively obtained by taking the ratio (ABN/ASP) of the area (ABN) including the peak to the area (ABN) including the peak of the metal soap.

Graphs in FIG. 1 illustrate Raman spectra of mixtures in which boron nitride is added to zinc stearate. As illustrated in FIG. 1, as the concentration of boron nitride increases (from FIG. 1A to 1D), the value of the peal between 1.387 $cm^{-1}$ and 1.341 $cm^{-1}$ increases. The concentration of boron nitride in FIG. 1 is the ration in mass of boron nitride to the total amount of the mixture.

Figure 2:
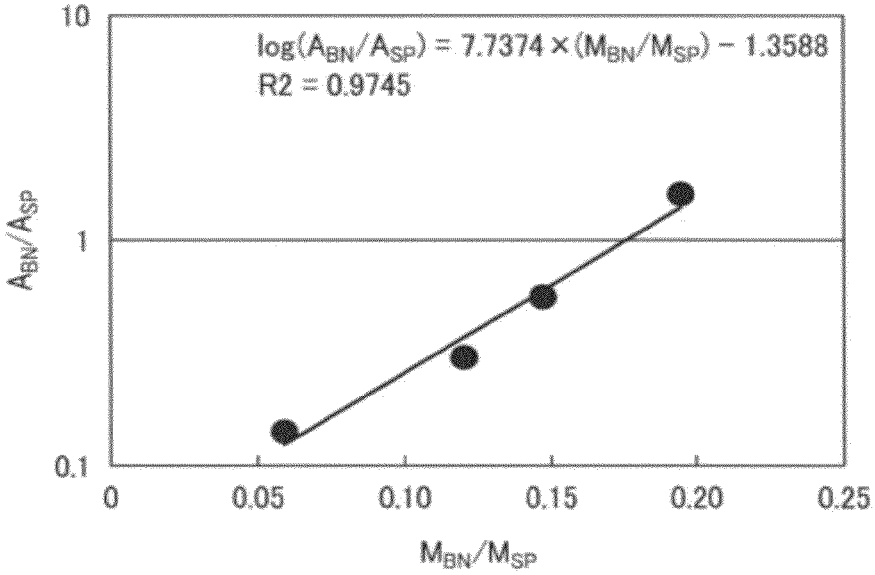
FIG. 2 is a graph illustrating a relationship between the ratio (ABN/ASP) of the peak area of boron nitride to that of zinc stearate and the ratio (MBN/MSP) of the weight of boron nitride to that of zinc stearate obtained from the Raman spectra illustrated in FIG. 1.

When plotting the ratio (ABN/ASP) of the peak area (ABN) of boron nitride to that (ASP) of metal soap (zinc stearate) obtained from Raman spectroscopic analysis of FIG. 1 based on the relationship with the weight ratio (MBN/MSP) of boron nitride to that of zinc stearate, a linear relationship is seen between logarithm of (ABP)/(ASP) and (MBN/MSP) as in the graph illustrated in FIG. 2. That is, from the logarithm of (ABN/ASP), the ratio (weight ratio) of boron nitride to stearic acid can be obtained.

The peak area is an area relating to Raman scattering intensity enclosed by the base line and the curve of the spectrum in the wave number range of Raman spectrum of from 1377.837 $cm^{-1}$ to 1354.695 $cm^{-1}$. In addition, the peak area of metal soap (zinc stearate in this case) is an area relating to Raman scattering intensity enclosed by the base line and the curve of the spectrum in the wave number range of Raman spectrum of from 1481.012 $cm^{-1}$ to 1420.264 $cm^{-1}$. Thus the present inventors have made the present invention.

Protective Agent Block

The protective agent block related to the present disclosure contains metal soap and boron nitride and based on Raman spectra measured at multiple places of the protective agent block, the average of the measured weight ratios Mr of boron nitride to the metal soap obtained from the relationship 1 per Raman spectrum is from 0.050 to 0.330 with a variation coefficient of 0.075 or less.

$$Mr=(\log(ABN/ASP)+1.3588)/7.7374 \quad \text{Relationship 1}$$

In the relationship 1, ABN represents the peak area in the range of from a wavenumber of 1377.837 $cm^{-1}$ to 1354.695 $cm^{-1}$ and ASP represents the peak area in the range of from a wavenumber of 1481.012 $cm^{-1}$ to 1420.264 $cm^{-1}$.

The average of the measured weight ratios Mr and the variation coefficient obtained by the Raman spectra measuring results are rounded off to three decimal places (hereinafter this applies to the average of the weight ratios Mr and the variation coefficient).

In the present disclosure, Raman spectra are measured at 20 places or more with a gap of 10 mm therebetween in the longitudinal direction of the protective agent block. The average (arithmetical mean) of the weight ratios Mr of boron nitride to the metal soap obtained from the relationship 1 per Raman spectrum is from 0.050 to 0.330, preferably from 0.060 to 0.300, and more preferably from 0.070 to 0.270. When the average of the weight ratios Mr is too small, the amount of boron nitride is too small so that the amount of the metal soap for use in the protective agent block that slips through the cleaning blade tends to increase, resulting in production of defective images with streaks. This is not preferable. In addition, when the average of the weight ratios Mr is too large, the cost of the protective agent block tends to increase because boron nitride is expensive. In addition, boron nitride tends to accumulate on the image bearing member (photoreceptor), which leads to production of non-sharp images in a high temperature/moisture environment.

In addition, the variation coefficient of the average of the weight ratios Mr of boron nitride to the metal soap obtained from the relationship 1 per Raman spectrum is obtained by dividing the standard deviation of the weight ratios Mr by the average (arithmetical mean) thereof and is 0.075 or less, preferably 0.060 or less, and more preferably 0.050 or less. When the variation coefficient is too large, defective images with streaks and image blur tend to be produced because the weight ratios Mr (i.e., content of boron nitride) tend to vary in the longitudinal direction of the protective agent block and also the protective agent block tends to be scraped at different speeds depending on the location in the protective agent block, which is not preferable.

Moreover, although the number of measuring points in Raman spectrum analysis for the protective agent block is preferably set to cover the area corresponding to the image forming area, 20 measuring points are sufficient to evaluate the weight ratio distribution of boron nitride to the metal soap.

The present disclosure can be applied irrespective of the thickness of the protective agent block and is particularly effective when the thickness is 15 mm or greater, preferably from 16 mm to 30 mm, and more preferably from 17 mm to 28 mm. The thickness of the protective agent block is the distance between the surface the brush to scrape the protective agent contacts and the substrate to which the protective agent block is fixed. When the thickness is too thin, the working life of the protective agent block tends to be shorter than that of the image bearing member, thereby increasing the frequency of the replacement of the image bearing member.

In addition, the metal soap for use in the present disclosure is preferably zinc stearate and/or zinc palmitate, i.e., zinc palmitate, zinc palmitate, or a mixture of zinc stearate and zinc palmitate. Since such metal soap has the same Raman spectra, any metal soap indicates almost the same weight ratio Mr obtained from the relationship 1.

Among such kinds of metal soap, a mixture of zinc stearate and zinc palmitate easily and uniformly covers the image bearing member when the linear speed of the image bearing member and the protection effect of the image bearing member from AC charging is high. Therefore, the mixture is preferable.

Zinc stearate and zinc palmitate are both metal salts of aliphatic (fatty) acid. With regard to the aliphatic portion thereof, the numbers of carbon atoms for stearate acid and palmitate are 18 and 16, respectively. Thus, the structures of zinc stearate and zinc palmitate are similar to each other and compatible well so that both compounds tend to behave as the significantly same material and protect the image.bearing member similarly.

In addition, since zinc palmitate has a lower melting point than zinc stearate, the protective agent containing both compounds are easily extended by a blade when zinc palmitate is contained in zinc stearate in a particular amount or more.

When the linear speed of the image bearing member is high, the charging energy received by the image bearing member, in the case of AC charging in particular, increases so that the protective agent layer on the image bearing member is desired to be thick to improve the protective effect for the image bearing member by the protective agent.

Zinc stearate is said to be stable when it is attached to the surface of the image bearing member in a two molecule form instead of at random attachment. Thus, when zinc stearate is applied to the surface of the image bearing member, the thickness of zinc stearate thereon is saturated by the thickness equal to two molecules of zinc sterate. When zinc palmitate, which has a slightly shorter molecule length than zinc stearate, is contained in at least a particular amount, the height of the molecule layer is not constant and thus the thickness of the protective agent layer changes depending on the location. The next molecule slips into the low portion to form a molecule layer. Consequently, a protective agent layer having a thickness greater than 2 molecule thickness of zinc stearate, which results in improvement on the protection effect for the image bearing member. Naturally, when the content of zinc palmitate is excessive, the 2 molecule layer of zinc palmitate tends to be formed and thus the protective agent layer is not thickened. Instead, the protection effect for the image bearing member deteriorates in comparison with the sole use of zinc stearate since the molecule of zinc palmitate is smaller than that of zinc stearate.

The protective agent block of the present disclosure containing metal soap and boron nitride is preferable to contain particulates having a feature of a filler. The filler contained together with boron nitride means that the filler is contained in the protection layer and demonstrates the feature of scraping boron nitride attached to the image bearing member in an excessive amount. There is no specific limit to the selection of the filler unless the selected filler is against the purpose of the present invention. Specific examples of the fillers include, but are not limited to, metal oxide particulates, metal multiple oxide particulates, organic particulates such as silicone resin particulates and silicone rubber particulates. Specific examples thereof include, but are not limited to, aluminum oxide (alumina), silicon oxide, titanium oxide, zirconium oxide, cerium oxide, strontium titanate, and methasilicate magnesium aluminate. Among these, alumina particulates are preferable in terms of stability, hardness, and availability of various kinds of particulate forms.

The protective agent block of the present disclosure is molded from a protective agent mainly formed of metal soap and boron nitride to protect an image bearing member to obtain a block form (bar form, cylinder form, quadratic prism form, hexagonal cylinder, etc.) according to the manufacturing method of the protective agent block of the present disclosure. The protective agent block of the present disclosure is extremely suitable to protect not only an image bearing member but also an intermediate transfer body.

Manufacturing Method of Protective Agent Block

The method of manufacturing the protective agent block related to the present disclosure is described next. When metal soap particulates and boron nitride particulates as they are compacted to manufacture a protective agent block having a thickness of 15 mm or greater in particular, it is difficult to manufacture a protective agent block having a uniform composition distribution (the variation coefficient of the weight ration of boron nitride to the metal soap is 0.075 or less) or the metal soap particulates and boron nitride particulates tend to leak from the gap in the compacting machine.

As described above, the present inventors pulverized the thinly-manufactured protective agent block, investigated pulverized particles, and found that the pulverized particles were by far larger than the particles before manufacturing but the metal soap and boron nitride were integrated in the pulverized particles, meaning that boron nitride is not particularly detached. Thus, the present inventors have made the present invention.

That is, the method of manufacturing the protective agent block of the present disclosure includes processing a mixture (powder mixture) containing at least powder of metal soap and powder of boron nitride in a predetermined manner, obtaining protective agent particles mainly formed of the metal soap and boron nitride having an average particle diameter of from 30 μm to 300 μm by particulating, and compacting the protective agent particles to obtain a protective agent block.

Any processing treatment is suitable in the particulating process as long as protective agent particles mainly formed of the metal soap and boron nitride having an average particle diameter of from 30 μm to 300 μm are obtained. For example, a process is suitable in which a mixture containing at least the metal soap powder and boron nitride powder is melted and fused followed by pulverization. However, since the powder is melted and fused, the obtained protective agent particulates are dense and hard particles, a protective agent block compacted using such particles is heavy burden on the power system in a protective agent applicator.

Figure 3:
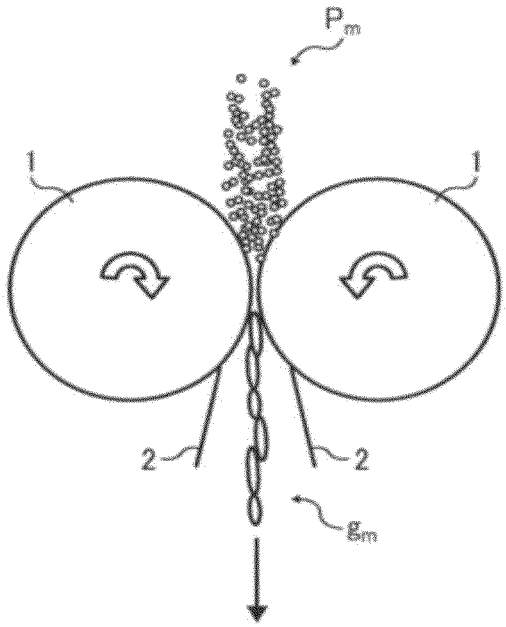
FIG. 3 is a schematic diagram illustrating an example in which powder mixture is subjected to pressure treatment by a pressing roller in the particulating process.

Therefore, as the processing treatment in the particulating process, it is preferable to compact a powder mixture containing at least metal soap powder and boron nitride powder followed by pulverization. It is good to classify the pulverized resultant to select the particles having an average particle diameter of from 30 μm to 300 μm. Under the pressure applied to the powder mixture during compacting, part of the portions where powder in the powder mixture contacts each other is melted and fused, which is maintained to obtain integrated protective agent particles. Such integrated protective agent particles tend to be loosened and easily spread on the surface of an image bearing member when applied thereto by a protective agent applicator. In addition, as the processing treatment in the particulating process, it is preferable to press the powder mixture containing at least metal soap powder and boron nitride powder by a roller. FIG. 3 is a diagram illustrating this process. In this diagram, while rotating a pair of pressing rollers 1 pressed against each other, a powder mixture Pm in which at least metal soap powder and boron nitride powder are uniformly mixed falls from above between the pressing rollers 1 to press the powder mixture Pm by the pressing rollers 1. In addition, the powder mixture Pm attached to the surface of the pressing rollers 1 is scraped by scrapers 2. It is suitable to press the powder mixture Pm such that part of the portion where powder contacts each other is melted. Thus, protective agent particles gm in which part of the portion where powder contacts each other is melted are obtained, which have flat forms with an average particle diameter of from 30 μm to 300 μm.

Figure 4:
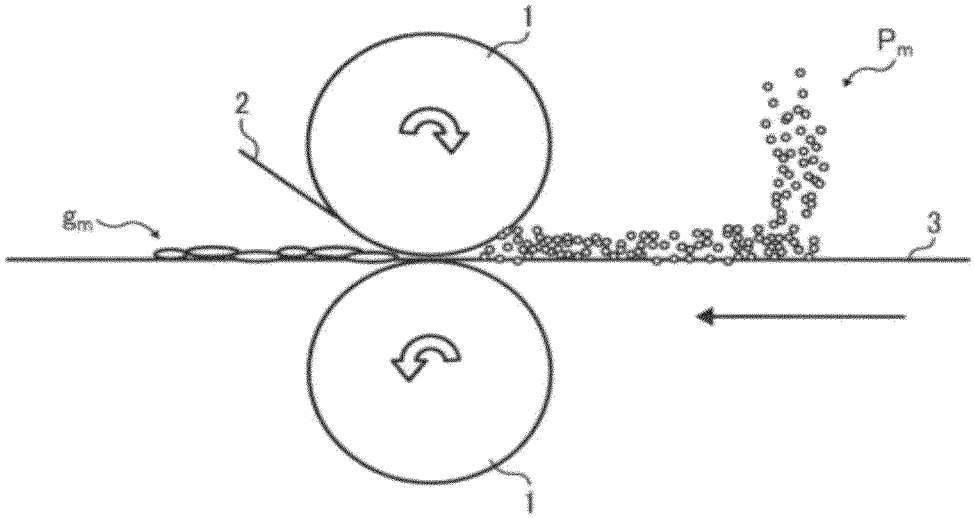
FIG. 4 is a schematic diagram illustrating another example in which powder mixture is subjected to pressure treatment by a pressing roller in the particulating process.

Alternatively, as illustrated in FIG. 4, while rotating a pair of pressing rollers 1 pressed against each other, it is suitable that a powder mixture Pm in which at least metal soap powder and boron nitride powder are uniformly mixed is conveyed between the pressing rollers 1 by a transfer belt 3 to press the powder mixture Pm by the pressing rollers 1. Thus, protective agent particles gm in which part of the portion where powder contacts each other is melted by the pressure applied by the pressing rollers 1 are obtained, which have flat forms with an average particle diameter of from 30 μm to 300 μm.

When the protective agent is applied by a protective agent applicator using the protective agent block manufactured from any of the thus-obtained protective agent particles gm, the protective agent particles gm are easily loosened on the surface of the image bearing member, thereby spreading the component of the metal soap and boron nitride on the surface of the image bearing member.

Although the powder mixture is pressed by the pressing rollers in the examples illustrated in FIGS. 3 and 4, the rollers can be replaced with gears. In addition, the obtained particles are optionally subjected to classification to select particles having desired particle diameters or remove undesirable particles to obtain the protective agent particles gm. Moreover, powder of the metal soap and the powder of boron nitride can be mixed by any known mixer such as container rotation type mixers such as a horizon cylinder type, a V type, a double cone type, and a cubic type or a container fixing type mixers using a mixing wing, air current, gravity, etc.

In addition, in each process (particulating process and compacting process) in the method of manufacturing the protective agent block of the present disclosure, it is suitable to suppress the heart generation to avoid compete fusion and melting of the metal soap. If the metal soap is melted and fused by heat applied thereto, when a thick protective agent having a thickness of, example, 15 mm or greater, is manufactured, the hardness of the protective agent tends to vary significantly depending on the location in the protective agent and the amount, which leads to a large variance in the amount and the size of the protective agent scraped by the brush in a protective agent applicator. Therefore, the protection layer to cover the image bearing member tends to be non-uniform so that the cleaning property of the portion where a less amount of the protective agent is applied deteriorates so that the toner component attaches thereto, resulting in production of non-vivid images, which is not preferable. In addition, the protective agent particles gm mainly formed of the metal soap and boron nitride has an average particle diameter of from 30 μm to 300 μm, preferably from 35 μm to 270 μm, and more preferably from 40 μm to 250 μm. When a thick protective agent block having a thickness of, for example, 15 mm or greater, is manufactured by using the protective agent particles having an excessively small average particle diameter, the mechanical strength of the protective agent block tends to be non-uniform, which is not preferable. When the average particle diameter is too large, the manufactured protective agent block tends to have a rough surface. Therefore, since a large force is applied to part of the protective agent particles, the part is melted and fused so that the amount of the protective agent scraped by the brush tends to be different, which leads to variation in the protective feature for the image bearing member, which is not preferable.

In addition, the protective agent particles gm mainly formed of the metal soap and boron nitride preferably has a cleaved surface like the cross section of the protective agent block described in JP-2010-26461-A. Therefore, if a thick protective agent block having a thickness of, for example, 15 mm or greater, is manufactured, the metal soap particles have a thin form and are spread by the blade after application to cover the image bearing member.

In addition, the content (weight ratio) of the metal soap and boron nitride in the protective agent particles gm is required to be constant, which is achieved by the particulating process in the manufacturing method of the protective agent block described above. It is preferable that the content (weight ratio) of the metal soap and boron nitride in the protective agent particles gm is quantatitvely measured by Raman spectrum analysis. How to obtain the content (weight ratio) of the metal soap and boron nitride in the protective agent particles gm is basically the same as how to obtain the content (weight ratio) of the metal soap and boron nitride in the protective agent block.

That is, in the method of manufacturing the protective agent block of the present disclosure, based on the Raman spectra obtained by measuring multiple samples of the protective agent particles gm obtained in the particulating process, the average of the measured weight ratios Mr of boron nitride to the metal soap obtained from the relationship 1 per Raman spectrum is from 0.050 to 0.330 with a variation coefficient of 0.070(0.075) or less.

$$Mr=(\log(ABN/ASP)+1.3588)/7.7374 \qquad \text{Relationship 1}$$

In the relationship 1, ABN represents the peak area in the range of from a wavenumber of 1377.837 $cm^{-1}$ to 1354.695 $cm^{-1}$ and ASP represents the peak area in the range of from a wavenumber of 1481.012 $cm^{-1}$ to 1420.264 $cm^{-1}$.

In the present disclosure, Raman spectra are measured at 1 place or more for each of multiple samples (e.g., 10 particles) of the protective agent particles gm obtained in the particulating process. The average (arithmetical mean) of the measured weight ratios Mr of boron nitride to the metal soap obtained from the relationship 1 per Raman spectrum is from 0.050 to 0.330, preferably from 0.060 to 0.300, and more preferably from 0.070 to 0.270. When the average of the weight ratios Mr is too small, the amount of boron nitride is too small so that the amount of the metal soap for use in the protective agent block that slips through the cleaning blade tends to increase, resulting in production of defective images with streaks. This is not preferable. In addition, when the average of the weight ratios Mr is too large, the cost of the protective agent block tends to increase because boron nitride is expensive. In addition, boron nitride tends to accumulate on the image bearing member (photoreceptor), which leads to production of non-sharp images in a high temperature/moisture environment. In addition, the variation coefficient of the average of the weight ratios Mr of boron nitride to the metal soap obtained from the relationship 1 per Raman spectrum is obtained by dividing the standard deviation of the weight ratios Mr by the average (arithmetical mean) and is 0.070 (0.075) or less, preferably 0.060 or less, and more preferably 0.050 or less. When the variation coefficient is too large, defective images with streaks and image blur tend to be produced because the weight ratios Mr (i.e., the content of boron nitride) tend to vary in the longitudinal direction of the protective agent block, which is not preferable.

By using such protective agent particles gm, the protective agent block of the present disclosure can be manufactured in the next process of compacting.

In the compacting process in the method of manufacturing the protective agent block of the present disclosure, the compacting method of molding the protective agent particles gm by compacting is used. When a protective agent block is formed by this compacting method, the obtained protective agent block has a different hardness depending the degree of compacting. Since the true specific gravity of the protective agent and the amount placed in the molding cast are known beforehand, compacting is adjusted such that the thickness reflecting the desirable degree of compacting is obtained. Therefore, the protective agent block can be manufactured with good reproducibility.

The compacting degree of the protective agent block is preferable such that the bulk specific gravity is from 88% to 98% and preferably from 90% to 95% based on the true specific gravity of the protective agent. When the bulk specific gravity of the protective agent is too low relative to the specific gravity thereof, the mechanical strength of the protective agent block tends to be weak so that cracking occurs when handling the protective agent block. When the bulk specific gravity of the protective agent block is too large relative to the true specific gravity, a pressing machine having a high power should be used, which leads to melting of part of the protective agent block. This causes the protective agent to have a locally dependent hardness, which is not preferred.

The protective agent block formed by compacting such that the bulk specific gravity of the protective agent is from 88 to 98% based on the true specific gravity can be easily finely powdered even when the brush is pressed against the protective agent block under a pressure weaker than in the case of a protective agent block manufactured by a melting and fusing molding method. Therefore, the brush does not deteriorate over an extended period of time so that the protective agent can be stably supplied to the image bearing member, which is preferred. In addition, when powder of boron nitride or alumina is mixed in the particulating process, a protective agent block that maintains the mixed state can be manufactured by the compacting method as long as mixing is sufficiently performed in the powder state.

In the image forming apparatus of the present disclosure, the image bearing member to which the protective agent is supplied from the protective agent block can be used as at least one of a photoreceptor and an intermediate transfer belt. In addition, the color image forming apparatus of late tend to use multiple photoreceptors for respective colors. The image bearing members may be used for all or some of the respective photoreceptors. Although it is most preferable to use the protective agent block of the present disclosure for all the photoreceptors and the intermediate transfer belt in terms of performance, the number of the protective agent blocks is preferably reduced because boron nitride is extremely expensive relative to the metal soap. In the tandem-type color image forming apparatus, images of respective colors are formed on the corresponding photoreceptors and transferred to the intermediate transfer belt to obtain a color image. Boron nitride in the protective agent block of the present disclosure is supplied to the photoreceptor together with the metal soap but most of boron nitride is not fixed on the photoreceptor but present between the photoreceptor and the blade so that the excess is transferred to the intermediate transfer belt when the images are transferred thereto. It is known that part of boron nitride transferred to the intermediate transfer belt moves back to the photoreceptor. Therefore, in the tandem type color image forming apparatus, it is possible to reduce production of defective images with streaks by using the protective agent block of the present disclosure only for a single photoreceptor or the intermediate transfer belt while providing a typical protective agent of the metal soap for each of the rest of the photoreceptors.

In addition, using the protective agent block of the present disclosure for the photoreceptor for black color is most preferable. Since black color is used much more frequently in image formation than the other colors, defective black images with streaks extremely stand out. Therefore, it is necessary to use the protective agent block of the present disclosure.

In an image forming apparatus using the protective agent of the present disclosure, the charging system that charges the image bearing member using a charging device is a contact or vicinity type and preferably uses an AC charging system in which an AC voltage is overlapped with a DC voltage. However, the image bearing member is charged several hundreds to several thousands of times per second depending on frequency when the AC charging system is used. Thus, the image bearing member is easily and heavily damaged in the AC charging system in comparison with the DC charging system in which an image bearing member is charged with only a positive discharging once while the image bearing member passes through the charging device. Therefore, since the damage to the image bearing member in the AC charging system is extremely large in comparison with the DC charging system, protecting the image bearing member from the damage caused by charging is highly demanded in the AC charging system. Therefore, a use of a protective agent containing boron nitride having a strong durability to discharging is extremely advantageous in comparison with a simple use of the metal soap. In addition, when the deterioration and/or abrasion of the image bearing member and the metal soap are accelerated by the use of the AC charging system, the blade is also degraded in an accelerated manner. Therefore, the presence of boron nitride is extremely advantageous to restrain the abrasion and minute vibration of the blade and stabilize the posture thereof.

The image forming apparatus using the protective agent block of the present disclosure preferably employs a process cartridge system in which a process cartridge is replaceable according to the working life of the image bearing member, etc. Therefore, the process cartridge of the present disclosure includes the image bearing member, the charging device, the development device, the cleaning device, the protective agent supply device, etc. described above for the image forming apparatus of the present disclosure. Such a process cartridge can be exchanged as a spare part of the image forming apparatus of the present disclosure and the substituted process cartridge demonstrates all the features described above and forms a suitable part in the image forming apparatus.

Next, embodiments of the protective agent block of the present disclosure are used with reference to drawings.

Embodiment 1

Figure 5:
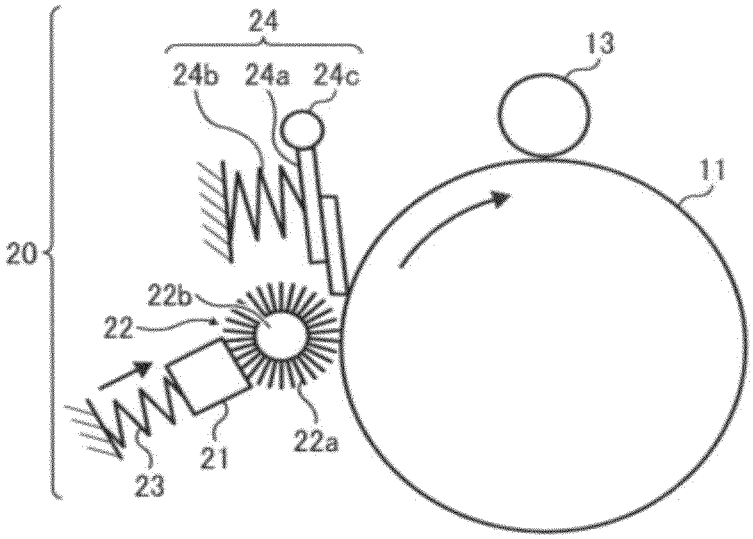
FIG. 5 is a schematic diagram illustrating an arrangement example of a protective agent supplying device to the image bearing member related to an image forming apparatus.

FIG. 5 is a diagram illustrating an example of arrangement of a protective agent supplying device to the image bearing member in an image forming apparatus.

A protective agent applicator 20 serving as a protective agent supplying device arranged facing an image bearing member (photoreceptor) 11 having a drum form has a protective agent block 21, which is the protective agent block of the present disclosure and molded to have a block form (bar form, cylinder form, quadratic prism form, hexagonal cylinder, etc.) to protect the image bearing member 11, a protective agent block supporting guide to support the protective agent block 21 not to swing any direction, and a protective agent supplying member 22 having a brush 22*a* which contacts the protective agent block 21 while rotating. Furthermore, the protective agent applicator 20 includes a pressure imparting mechanism (e.g., spring) 23 that transfers the protective agent to the brush 22*a* of the protective agent supplying member 22 by pressing the protective agent block 21 against the brush 22*a* of the protective agent supplying member 22 and a protection layer formation mechanism 24 that thin-layers the protective agent supplied to the surface of the image bearing member by the protective agent supplying member 22.

Figure 6:
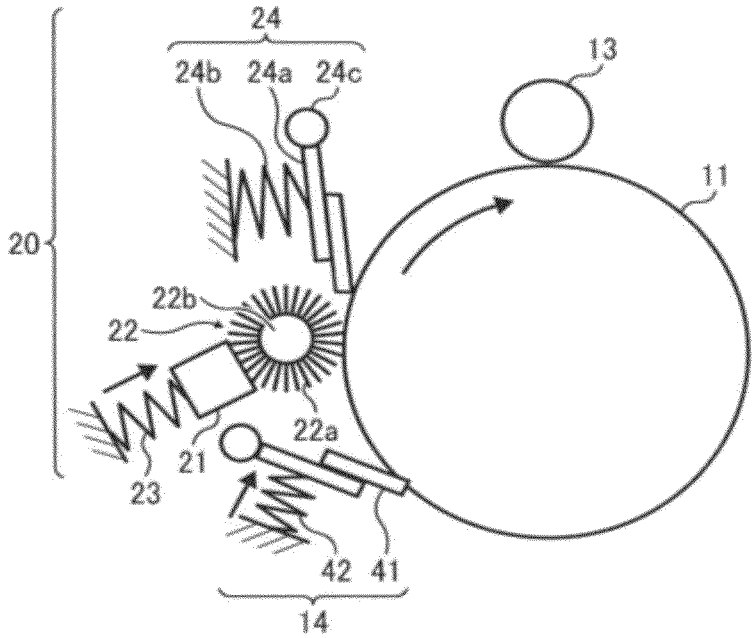
FIG. 6 is a schematic diagram illustrating another arrangement example of a protective agent supplying device to the image bearing member related to an image forming apparatus.

FIG. 6 is a diagram illustrating another example of arrangement of the protective agent supplying device to the image bearing member in an image forming apparatus. The protective gent applicator 20 serving as the protective agent device in FIG. 6 is the same as in FIG. 5. In FIG. 1, a numeral reference 14 represents a cleaner serving as a cleaning device of the image bearing member 11 which is placed upstream from the protective agent applicator 20 relative to the rotation direction of the image bearing member 11. The cleaner 14 cleans the surface of the image bearing member 11 before the protective agent is applied thereto to cause the image bearing member 11 to be properly charged. In addition, since the cleaner 14 has a feature of helping a suitable application of the protective agent, the cleaner 14 can be regarded as part of the protective agent applicator 20.

The protective agent block 21 related to the present disclosure is pressed against the brush 22*a* of the protective agent supplying member 22 by the pressure from the pressure imparting mechanism 23 formed of a pressing member such as a spring, etc. so that part of the protective agent 21 is attached to the brush 22*a*. The attachment amount of the protective agent to the brush 22*a* can be changed by varying the pressure of the spring, etc. The protective agent supplying member 22 rotates at a different linear speed from that of the image bearing member 11 and thus the front end of the brush 22*a* abrasively slides with the surface of the image bearing member 11 in order to supply the protective agent attached to the surface of the brush 22*a* to the surface of the image bearing member 11.

The protective agent supplied to the surface of the image bearing member 11 may not form a uniform protection layer at the time of supplying the protective agent. Therefore, the protection layer formation mechanism 24 having an extension blade 24*a* and a pressing member 24*b* such as a spring is provided to extend the protective agent supplied to the surface of the image bearing member 11 to form a thin and uniform protection layer on the image bearing member 11. The extension blade 24*a* of the protection layer formation mechanism 24 employs a counter system in which the extension blade 24*a* is in contact with the surface of the image bearing member 11 in a counter manner.

As described above, a suitable amount of the protective agent is applied to the image bearing member 11 and is thin-layered by the protection layer formation mechanism 24 to form a protection layer on the image bearing member 11. Thus, production of defective images ascribable to contamination on a charging device (e.g., charging roller) 13 illustrated in FIG. 13 is avoided and an image forming apparatus that can output quality images for an extended period of time without frequent replacement of consumables is obtained. There is no specific limit to the selection of material for use in the extension blade 24*a* contained in the protection layer formation mechanism 24 and any known material for a cleaning blade can be used. Specific examples thereof include, but are not limited to, an elastic body such as urethane rubber, hydrine rubber, silicone rubber, and fluorine rubber. Theses can be used alone or blended. In addition, the contact portion of these rubber blades with the image bearing member 11 can be subject to coating or impregnation treatment using a material having a low friction coefficient. In addition, fillers such as organic fillers or inorganic fillers can be dispersed in the elastic body to adjust the hardness thereof.

The extension blade 24*a* is fixed to a blade support 24*c* by an arbitrary method using, for example, adhesion or attachment such that the front end of the blade is directly in contact with and pressed against the surface of the image bearing member 11. The thickness of the extension blade 24*a* is not necessarily unambiguously regulated considering the balance between the thickness of the extension blade 24*a* and the applying pressure but is preferably from about 0.5 mm to about 5 mm and more preferably from about 1 mm to about 3 mm.

In addition, the length, i.e., free length, of the extension blade 24*a* having flexibility which protrudes from the support 24*c* is also not necessarily unambiguously regulated considering the balance between the free length and the applying pressure but is preferably from about 1 mm to about 15 mm and more preferably from about 2 mm to about 10 mm.

As other structures of the extension blade 24 for use in protection layer formation, a layer of resin, rubber, elastomer, etc. is formed on the surface of an elastic metal blade such as a spring board by coating, dipping etc., via an optional material such as a coupling agent or a primer component, and optionally, thermally cured. The formed layer can be further subjected to surface grinding treatment, if desired. The elastic metal blade has a thickness of preferably from about 0.05 mm to about 3 mm and more preferably from about 0.1 mm to about 1 mm. The elastic metal blade can be subjected to treatment such as bending work to cause the blade significantly parallel to the spindle (shaft) after attachment to prevent distortion of the blade. Material such as fluorine resins such as (polyperfluoro alkyl ether (PFA), polytetrafluoroethylene (PTFE), copolymers of perfluoroethylene and perfluoropropylene (FEP), and (polyvinylidene fluoride (PVdF), fluorine rubber, and silicone-based elastomers such as methylphenyl silicone elastomers can be used with an optional bulking agent to form the surface layer of the elastic metal blade.

The front end of the blade 24*a* that contacts the image bearing member 11 is positioned to form an obtuse angle against the image bearing member 11 as illustrated in FIGS. 5 and 6. If the formed angle is a right angle, the front end of the blade is easily drawn to the moving direction of the surface of the image bearing member 11, which may cause vibration of drawing and returning of the blade. When the blade vibrates, non-uniform protection layer tends to be formed and part of boron nitride is easily isolated. To the contrary, when such a blade forming an obtuse angle is used as illustrated in FIGS. 5 and 6, the front end of the blade is hardly drawn to the moving direction of the image bearing member 11 and the metal soap and boron nitride form a uniform protection layer, thereby preventing boron nitride that tends to be isolated from slipping through the extension blade 24*a* and excessively attaching to the surface of the image bearing member 11. Thus, contamination of the charging roller is also reduced, which is extremely preferable.

The pressure to press the blade 24*a* against the image bearing member 11 by the pressure member 24*b* of the protection layer formation mechanism 24 is sufficient if the protective agent on the image bearing member 11 is spread to form a uniform protection layer. The linear pressure is preferably from 5 gf/cm to 80 gf/cm and more preferably from 10 gf/cm to 60 gf/cm.

The brush 22*a* is preferably used as the protective agent supply member 22 and preferably has flexibility to reduce the mechanical stress on the surface of the image bearing member 11. Any known material or a combination thereof is selectively used to form flexible brush fiber. Specific examples thereof include, but are not limited to, polyolefin based resins (e.g., polyethylene and polypropylene); polyvinyl based resin or polyvinylidene based resins (e.g., polystyrene, acrylic resin, polyacrylonitrile, polyvinylacetate, polyvinyl alcohol, polyvinyl butyral, polyvinyl chloride, polyvinyl carbazole, polyvinyl ether, and polyvinyl ketone); copolymers of polyvinyl chloride and vinyl acetate; copolymers of styrene and acrylic acid; styrene-butadiene resins; fluorine resins (e.g., polytetrafluoroethylene, polyvinyl fluoride, polyvinylidene fluoride, polychloro trifluoroethylene); polyester; nylon; acryl: rayon; polyurethane; polycarbonate: phenol resin; and amino resin (e.g., urea-formaldehyde resin, melamine resin, benzoguanamine resin, urea resin and polyamide resin). Among these, the resins having flexibility can be used.

Dien-based rubber, styrene-butadiene rubber (SBR), ethylene propylene rubber, isoplene rubber, nitrile rubber, urethane rubber, silicone rubber, hydrin rubber, norbornene rubber, etc, can be mixed with the brush fiber material specified above to adjust the degree of flexibility (bend).

The support member 22*b* of the protective agent supplying member 22 can take a fixed form or a rotatable roll form. For example, a roll brush formed by winding a tape formed of pile fabric made from brush fiber around a core metal in a spiral manner can be used as the support member 22*b* having a roll form. The brush fiber has a diameter of from 10 μm to 500 μm and preferably from 20 μm to 300 μm. A brush fiber having an excessively small diameter tends to slow down the supply speed of the protective agent, which is not preferable. A brush fiber having an excessively large diameter tends to reduce the number of brush fibers per unit area. This causes uneven application of the protective agent on the image bearing member 11 to be significant because the brush fiber does not contact depending on locations on the image bearing member 11. In addition, the image bearing member 11 is easily damaged by the contact with the brush 22*a*. Furthermore, since the force to scrape off the protective agent is strong, the working life of the protective agents is shortened. Also, the protective agent supplied to the image bearing member 11 tends to form a large particle. Thus, the large particles transferred to the charging roller 13 tend to contaminate the charging roller 13. Additionally, the large sized particles tend to increase the torque to rotate the brush 22*a* and the image bearing member 11, which is not preferred.

The brush fiber has a length of from 1 μm to 15 μm, and preferably from 3 μm to 10 μm. When the brush fiber having an excessively short length is used, the core metal of the brush 22*a* is arranged in the immediate vicinity with the image bearing member 11 and thus tends to be damaged by contact with the image bearing member 11, which is not preferable. A brush fiber having an excessively long length tends to weaken the force to scrape off the protective agent by the top of the brush fiber and apply pressure against the image bearing member 11. This is not preferred because supplying an ample amount of the protective agent to the image bearing member 11 is difficult and the brush easily falls out.

The density of the brush of the brush 22*a* is from 10,000 to 300,000 pieces of fiber per square inch ($1.5\times10^7$ to $4.5\times10^8$ pieces of fiber per square meter). A brush density that is too thin is not preferred because uneven application of the protective agent on the image bearing member 11 is noticeable due to the fact that the brush fiber does or does not contact depending on locations on the image bearing member 11, and supplying an ample amount of the protective agent to the image bearing member 11 becomes difficult. In addition, an excessively high brush density requires an excessively small diameter of the brush fiber, which is not preferable.

The protective agent supply member 22 preferably has a high brush density in terms of supply uniformity and supply stability. In addition, one piece of fiber is preferably manufactured from several to several hundreds of minute pieces of fiber. For example, as in 333 decitex (=6.7 decitex×50 filaments) (=300 denier=6 denier×50 filaments), 50 pieces of fine fiber each having 6.7 decitex (6 denier) are bundled and implanted as one piece of fiber.

Among these protective agent supplying members 22, the brush 22*a* formed of single fiber of from 28 μm to 43 μm and preferably from 30 μm to 40 μm is most preferable in terms of the efficiency of supply of the protective agent. The fiber is mostly manufactured by twisting. Thus, the diameter of the fiber is not uniform and the units of denier and decitex have been used. However, since a single piece of fiber has a uniform diameter, the protective agent supply member 22 is preferably specified by the fiber diameter.

A diameter of a single piece of the fiber that is excessively small or large is not preferred because a diameter that is excessively small tends to reduce the efficiency of supplying the protective agent and a diameter that is excessively large tends to lead to excessive stiffness, thereby easily damaging the image bearing member 11. In addition, a single piece of fiber having a diameter of from 28 μm to 43 μm is preferably implanted to the core metal with an angle as close as possible to a right angle. The brush is preferably manufactured by electrostatic implanting using static electricity. The electrostatic implanting is a method in which the core metal is charged to fly a single piece of fiber having a diameter of from 28 μm to 43 μm by the electrostatic force to implant it on an adhesive applied to the core metal followed by curing the adhesive. A brush manufactured by electrostatic implanting which has a density of from 50,000 to 600,000 pieces of fiber per square inch is suitably used.

In addition, a covering layer can be optionally formed on the surface of the brush 22*a* to stabilize the surface form of the brush 22*a* and environment stability. Any component that is flexible (bending property) according to the bending of the brush fiber is preferably used to form the covering layer. Specific examples thereof include, but are not limited to, polyolefin resins such as polyethylene, polypropylene, chlorinated polyethylene, and chlorosulfonated polyethyelene; polyvinyl or polyvinylidene resins such as polystyrene, acryl (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; copolymers of vinyl chloride and vinyl acetate; silicone resins or modified products thereof having organosiloxane binding (e.g., modified products of alkyd resins, polyester resins, epoxy resins, or polyurethane resins); fluorine containing resins such as perfluoroalkyl ether, polyfluorovinyl, polyfluorovinylidene, and polychloro trifluoroethylene; polyamides; polyesters; polyurethanes; polycarbonates; amino resins such as urea and formaldehyde resins; epoxy resins; and complex resins thereof.

Embodiment 2

Figure 7:
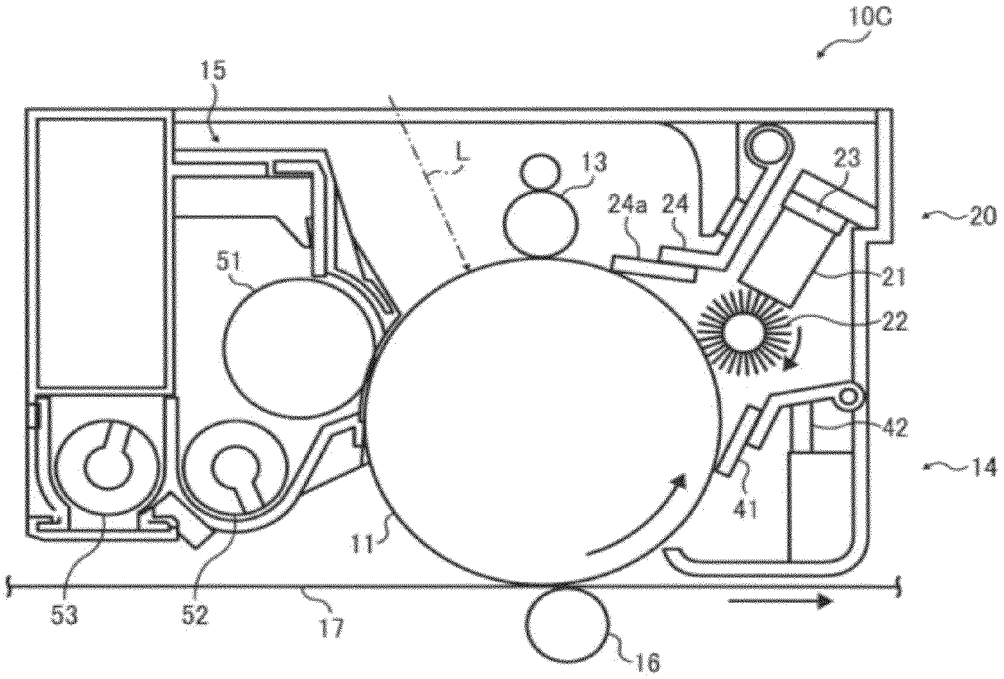
FIG. 7 is a cross section illustrating an example of the structure of the process cartridge related to the present disclosure.

The process cartridge and the image forming apparatus of the present disclosure are described next. FIG. 7 is a cross section illustrating a schematic structure example of the process cartridge having the protective agent applicator 20, which is provided to the image formation portion of the image forming apparatus of the present disclosure. In FIG. 7, an image formation portion 10 illustrated in FIG. 8 includes: the image bearing member (photoreceptor) 11 having a drum form; a charger (charging roller in FIG. 7) 13 that charges the image bearing member 11; a latent image formation device that irradiates the image bearing member 11 with a laser beam L to form a latent electrostatic image thereon; a development device 15 that develops the latent electrostatic image on the image bearing member 11 with toner to obtain a visual (toner) image; a transfer device 16 that transfers the toner image to a transfer medium 17 (or intermediate transfer body); a cleaner 14 that removes toner remaining on the surface of the image bearing member 11 after transferring to clean the surface of the image bearing member 11; and the protective agent applicator 20 serving as the protective agent supplying device arranged between the cleaner 14 and the charging device 13. This image formation portion 10 uses a process cartridge 10C including the image bearing member 11, the protective agent applicator 20, the charging device 13, the development device 15, and the cleaner 14. In the present invention, the cleaner 14 is regarded as part of the protective agent applicator 20 from a certain point of view because the cleaner 14 has a feature of cleaning the surface of the image bearing member 11 before application of the protective agent to promote smooth application of the protective agent.

In FIG. 7, the charging device 13, the latent image formation device, and the development device 15 form an image formation device. The charging device 13 is, for example, a charging roller employing an AC charging system in which an AC voltage is overlapped with a DC voltage by a high voltage power source. In addition, the development device 15 is formed of a development roller 51 serving as a development agent bearing member that bears and transfers toner particles or a mixture of toner particles and carrier particles, and a development agent stirring and transfer members 52 and 53 that transfer the development agent while stirring.

As illustrated in FIGS. 5 and 6, the protective agent applicator 20 arranged facing the image bearing member 11 is mainly formed of the protective agent block 21, the protective agent application member 22, the pressure imparting mechanism 23, the protection layer formation mechanism 24, and the protective agent block support guide that supports the protective agent block 21 in order for the protective agent block 21 not to swing any direction.

In addition, the image bearing member 11 has a surface on which partially degraded protective agent and toner components remain after the transfer process but the surface is cleaned by a cleaning blade 41 of the cleaner 14. In FIG. 7, the cleaning blade 41 having a blade form is supported by a cleaning pressure imparting mechanism 42 and brought into contact with the image bearing member 11 with an angle in a counter manner (leading type).

The protective agent of the protective agent block 21 is supplied from the protective agent supply member 22 having a brush form to the surface of the image bearing member 11 from which the residual toner and the degraded protective agent have been removed by the cleaner 14. The protective agent supplied to the surface of the image bearing member 11 is thin-layered by the blade 24*a* of the protection layer formation mechanism 24 to form the protection layer.

A latent electrostatic image is formed on the image bearing member 11 having the thus prepared protection layer by irradiation of, for example, the laser beam L after charging the image bearing member 11 by the charging roller 13 and developed with toner by the development device 15 to obtain a visual image. Thereafter, the visual image is transferred to the transfer medium 17 (or intermediate transfer medium) such as transfer paper by the transfer device 16 (e.g., transfer roller) situated outside the process cartridge 10C.

A small sized charging roller that produces a less amount of oxidation gases such as ozone is used as the charging device 13 for use in the process cartridge 10C. The charging roller 13 is arranged in contact with or in the vicinity (from 20 μm to 100 μm) of the image bearing member 11 and charges the image bearing member 11 by applying a voltage between the charging roller 13 and the image bearing member 11. AC voltage which is overlapped with DC voltage is used as the voltage applied between the charging roller 13 and the image bearing member 11. In the case of AC charging, the image bearing member 11 is easily degraded by discharging occurring more than several hundreds of times per second between the image bearing member 11 and the charging roller 13. In addition, the protective agent applied to the surface of the image bearing member 11 is also degraded by discharging and may disappear. Thus, application of the protective agent to the surface of the image bearing member 11 in a constant amount is a great factor.

The charging roller preferably has a layer structure in which a polymer layer and a surface layer are provided on the electroconductive substrate. The electroconductive substrate serves as the electrode and a supporting member of the charging roller 13 and is formed of an electroconductive material, for example, metal or alloyed metal such as aluminum, alloy of copper, and stainless steel, electroplated iron with chrome, nickel, etc., and resins to which an electroconductive agent is added.

An electroconductive layer having a resistance of $10^6$ to $10^9 \Omega \cdot cm$ is preferable as the polymer layer and a material in which electroconductive agent is admixed with a polymer material to adjust the resistance is suitably used. Specific example of the polymers for use in the polymer layer of the charging roller 13 for use in the image forming apparatus of the present invention include, but are not limited to, thermoplastic elastomers based on polyesters or olefins, polystyrene and styrene based thermoplastic resins such as copolymers of styrene and butadiene, copolymers of styrene and acrylonitrile, copolymers of styrene, butadiene and acrylonitrile, isoplene rubber, chloroplene rubber, epichlorohydrin rubber, butyl rubber, urethane rubber, silicone rubber, fluorine rubber, styrene-butadiene rubber, butadiene rubber, nitrile rubber, ethylene propylene rubber, copolymer rubber of epichlorohydrin-ethyleneoxide, copolymer rubber of epichlorohydrin-ethyleneoxide-arylglycidyl ether, three-dimension copolymer rubber of ethylene-propylne-dien (EPDM), copolymer rubber of acrylonitrile-butadiene, natural rubber and blended rubber material thereof. Among these rubber materials, silicone rubber, ethylene propylene rubber, copolymer rubber of epichlorohydrin-ethyleneoxide, copolymer rubber of epichlorohydrin-ethyleneoxide-arylglycidyl ether, copolymer rubber of acrylonitrile-butadiene, and rubber blend thereof are preferably used. These rubber materials that formed of a foamed or non-foamed material are also suitably used.

Electron conductive agents and ion conductive agents are used as the conductive agents. Specific examples of the electron conductive agents include, but are not limited to, fine powder of carbon blacks such as Ketjen black and acethylene black, pyrolytic carbon, graphite, electroconductive metals or alloyed metals such as aluminum, copper, nickel, stainless steel or alloyed metals, electroconductive metal oxides such as tin oxide, indium oxide, titanium oxide, solid dispersion of tin oxide and antimony oxide, solid dispersion of tin oxide and indium oxide, and insulative material whose surface is electroconductive-treated. In addition, specific examples of the ion electroconductive agents include, but are not limited to, perchlorates or chlorates of tetraethyl ammonium, lauryl trimethyl ammonium, and perchlorates or chlorates of alkali metals or alkali earth metals such as lithium and magnesium. These electroconductive agents can be used alone or in combination. In addition, there is no specific limit to the addition amount thereof but the content of the electron conductive material is preferably from 1 part by weight to 30 parts by weight and more preferably from 15 parts by weight to 25 parts by weight based on 100 parts of a polymer. The content of the ion conductive material is preferably from 0.1 parts by weight to 5.0 parts by weight and more preferably from 0.5 parts by weight to 3.0 parts by weight based on 100 parts of a polymer.

As described above, there is no specific limit to the polymer material that forms the surface layer as long as the dynamic super microhardness of the surface of the charging roller 13 is from 0.04 to 0.5. Specific examples of the polymer material include, but are not limited to, polyamide, polyurethane, polyvinylidene fluoride, copolymers of tetrafluoroethylene, polyester, polyimide, silicone resins, acrylic resins, polyvinyl butyral, copolymers of ethylene tetrafluoro ethylene, melamine resins, fluorine rubber, epoxy resins, polycarbonoate, polyvinyl alcohol, cellulose, polyvinylidene chloride, polyvinyl chloride, polyethylene, and copolymers of ethylene vinyl acetate. Among these, polyamide, polyvinylidene fluoride, copolymers of tetrafluoroethylene, polyester, and polyimide are preferred in terms of the releasing property with toner, etc. These polymers can be used alone or in combination. In addition, the number average molecular weight of the polymers is preferably from 1,000 to 100,000 and more preferably from 10,000 to 50,000.

The surface layer is formed of a composition (mixture) in which the electroconductive agent for use in the electroconductive elastic layer and various kinds of particulates are mixed with the polymer material specified above. Specific examples of the various kinds of particulates include, but are not limited to, metal oxides and complex metal oxides such as silica, aluminum oxide, and barium titanate, polymer fine powder such as tetrafluoroethylene and vinylidene fluoride. These can be used alone or mixed for use.

The development device for use in the process cartridge of the present disclosure brings the development agent into contact with the image bearing member 11 and develops a latent image formed on the image bearing member 11 with the development agent to obtain a toner image. A two-component development agent including toner and carrier or a single component development agent having no carrier can be used as the development agent. The development roller 15 serving as the development agent bearing member in the development device 15 is partially exposed from the casing thereof as illustrated in FIG. 7.

The toner replenished from a toner bottle into the development device 15 is transferred and stirred with carrier by the development agent stirring and transfer members (screws) 52 and 53 to the development roller 51 where the toner is borne. This development roller 51 is formed of a magnet roller serving as a magnetic field generation device and a development sleeve concentrically rotating around the magnet roller. The carrier in the development agent forms a filament on the development roller 51 by the magnetic force generated by the magnet roller and the filament is transferred to the development area facing the image bearing member 11. The surface of the development roller 51 moves in the same direction as the surface of the image bearing member 11 at a speed higher than that of the surface of the image bearing member 11 in the development area. The carrier forming the filament on the development roller 51 supplies toner attached to the surface of the carrier to the surface of the image bearing member 11 while abrasively sliding the surface of the image bearing member 11. A development bias is applied to the development roller 51 by a power source to form a development electric field in the development area. Consequently, a thus-generated electrostatic force between the latent electrostatic image on the image bearing member 11 and the development roller 51 is applied to the toner on the development roller 51 in the direction toward the latent electrostatic image. Therefore, the toner on the development roller 51 is attached to the latent electrostatic image on the image bearing member 11. The latent electrostatic image on the image bearing member 11 is developed by this attachment to form a toner image thereon.

According to the process cartridge of the present disclosure, quality images can be formed for an extended period of time because the protective agent block 21 is used.

Embodiment 3

Figure 8:
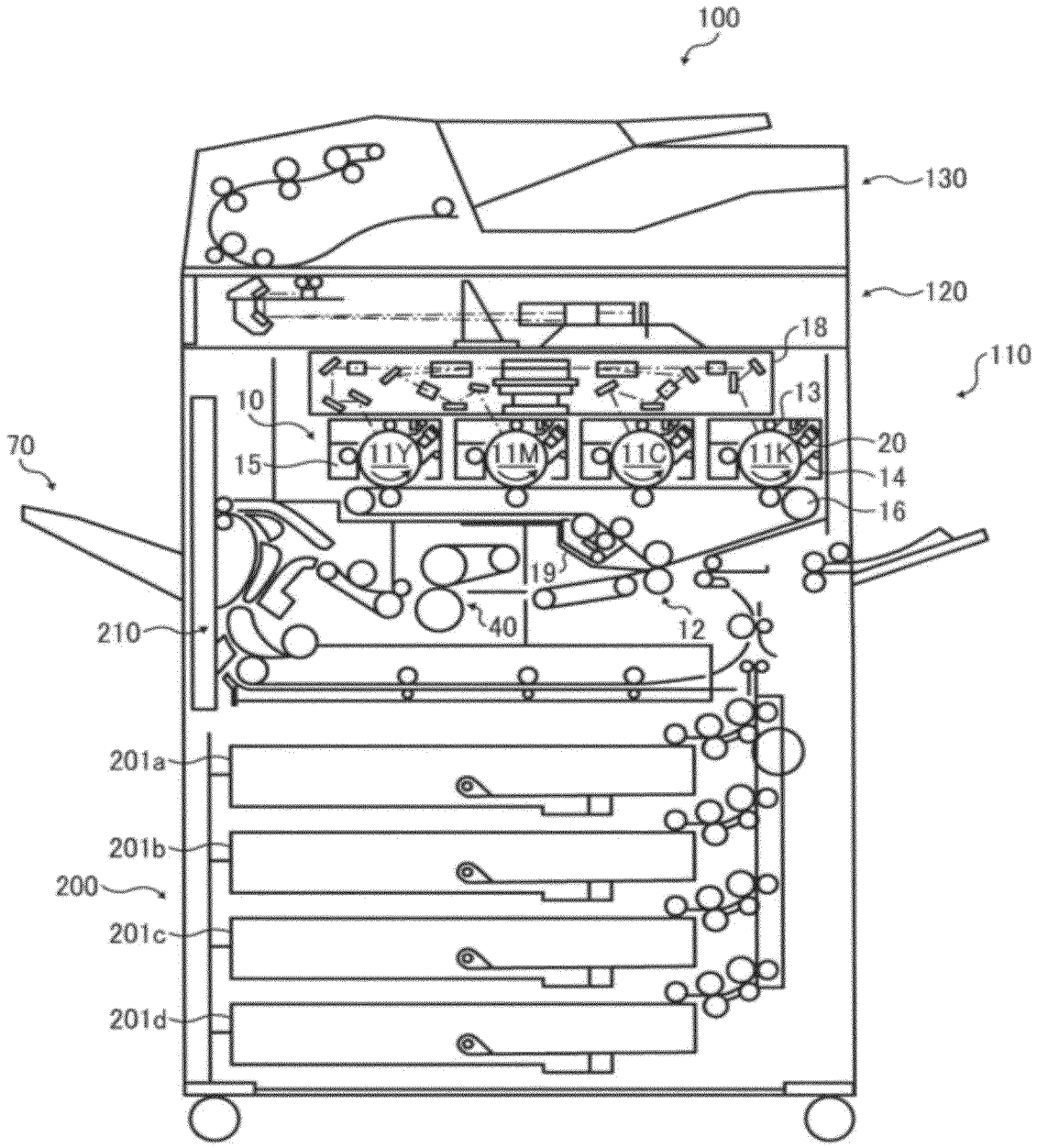
FIG. 8 is a cross section illustrating an example of the image forming apparatus related to the present disclosure.
Figure 9:
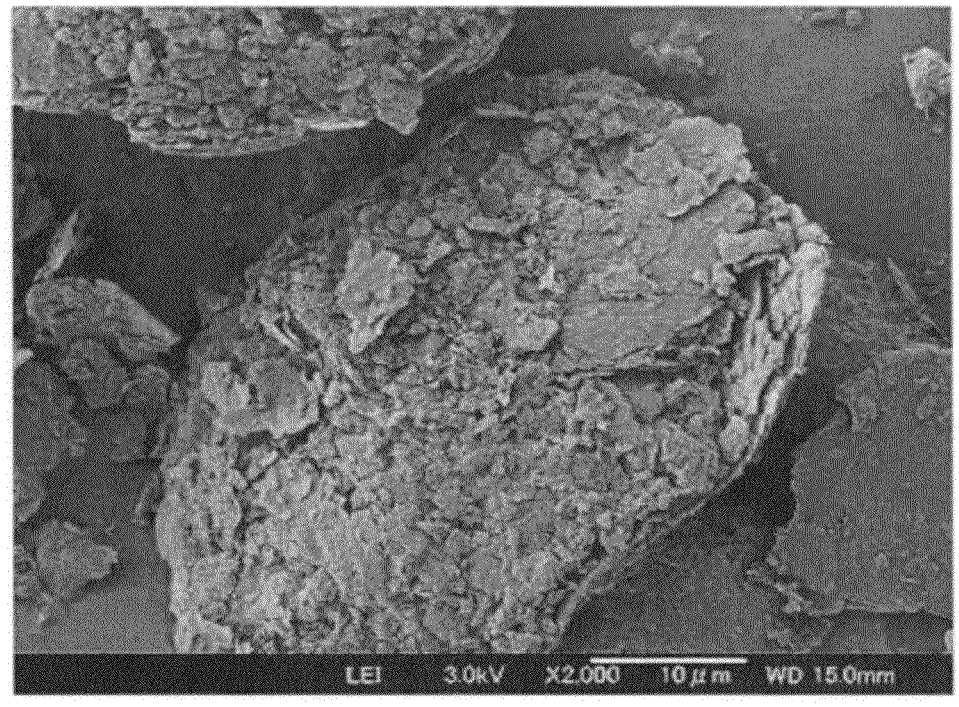
FIG. 9 is a scanning electron microscope (SEM) image of the protective agent particles manufactured in Example 1 described later.

Another embodiment of the image forming apparatus of the present disclosure is described next. FIG. 8 is a schematic diagram illustrating an example of the structure of an image forming apparatus 100 having the protective agent applicator having the protective agent block of the present disclosure. The image forming apparatus 100 includes a main body (printer portion) 110 of the image forming apparatus 100 that forms images, a document reader (scanner) 120 provided on the top of the main body 110, an automatic document feeder (ADF) 130 provided on the scanner 120, and a paper feeder 200 provided below the main body 110 and has a feature of photocopying. In addition, the image forming apparatus 100 has a communication ability with an outer device and thus can be used as a printer or a scanner when connected with a home computer provided outside the image forming apparatus 100. Furthermore, the image forming apparatus 100 connected with the telephone communication or optical line can be used as a facsimile machine.

Four image formation portions (image forming stations) 10 of the development device 15, each of which has the same structure while containing different color toner, are arranged in parallel in the main body 110. Images developed with toner having different colors of yellow (Y), magenta (M), cyan (C), and black (K) are formed at the four image formation portions 10 and each color toner image is transferred to and superimposed on a transfer medium or an intermediate transfer medium to form a multiple color or full color image. The four image formation portions 10 in the example illustrated in FIG. 8 are arranged in parallel along the intermediate transfer medium 17 having a belt form suspended over multiple rollers. The color toner images produced at the respective image formation portions 10 are transferred to the intermediate transfer medium 17 where the color toner images are superimposed sequentially and thereafter transferred to a transfer medium having a sheet form such as paper at once by a secondary transfer device 12.

Each image formation portion 10 for each color has the same structure as illustrated in FIG. 7 and includes the protective agent applicator 20, the charging device 13, an irradiation portion that emits a laser beam, etc. from a latent image formation device 18, the development device 15, a primary transfer device 16, and the cleaner 14, which are arranged around the image bearing member 11 (11Y, 11M, 11C and 11K). The image formation portion 10 for each color uses a process cartridge 10C including the image bearing member 11, the protective agent applicator 20 (including the cleaner 14), the charger 13, and the development device 15. This process cartridge 11 is detachably attachable to the main body 110 of the image forming apparatus.

The behavior of the image forming apparatus 100 is described with reference to FIG. 8. A series of the image formation processes are described using a negative-positive process. The behavior of each image formation portion 10 is the same and thus the behavior of one of them is described.

The image bearing member 11, which is an image bearing member typically represented by an organic photoconductor (OPC) having an organic photoconductive layer, is discharged by a discharging lamp and uniformly charged with a negative polarity by the charging device 13 having a charging member (e.g. charging roller). When the image bearing member 11 is charged by the charging device 13, a voltage application mechanism applies a charging bias having a suitable DC voltage or a voltage in which an AC voltage is overlapped with the suitable DC voltage to the charging member such that the image bearing member 11 is charged to a desired voltage.

A latent image is formed on the charged image bearing member 11 by a laser beam emitted from the latent image formation device 18 employing a laser scanning system formed of, for example, multiple laser beam sources, a coupling optical system, an optical deflection device, a scanning image focusing optical system, etc. The absolute voltage at the irradiated portion is lower than the absolute voltage at the non-irradiated portion. The laser beam emitted from a laser beam source (e.g., semiconductor laser) is deflected by an optical deflection device including a polygon mirror having a polygonal column that rotates at a high speed and scans the surface of the image bearing member 11 in the rotation axis direction (main scanning direction) of the image bearing member 11 via a scanning image focusing optical system formed of a scanning lens, mirrors, etc.

The thus formed latent image is developed by toner particles or a mixture of toner particles and carrier particles supplied onto the development sleeve of the development roller 51 functioning as a development agent bearing member included in the development device 15 to form a visualized toner image. When the latent image is developed, the voltage application mechanism applies a development bias of a suitable DC voltage or AC voltage in which an AC voltage is overlapped with the suitable DC voltage to the development sleeve of the development roller 51.

The toner images formed on the image bearing members 11 of the image formation portions 10 corresponding to respective colors are primarily transferred sequentially to and overlapped atop on the intermediate transfer medium 17 at the primary transfer device 16 including a transfer roller, etc. At the same time, the transfer medium having a sheet form such as paper is fed from a paper feeder cassette selected among multiple-stacked paper feeding cassettes 201*a*, 201*b*, 201*c*, and 201*d* of the paper feeder 200 by the paper feeding mechanism formed of a paper feeding roller and a separation roller in synchronization with the timing of image formation and primary transfer, and transferred to the secondary transfer portion via transfer rollers and registration rollers. The toner image on the intermediate transfer medium 17 is secondarily transferred to the transfer medium at the secondary transfer portion by a secondary transfer device (for example, secondary transfer roller). A voltage having a polarity reversed to that of the toner charging is preferably applied to the primary transfer device 16 and the secondary transfer device 12 as a transfer bias in the transfer process described above.

Thereafter, the transfer medium is separated from the intermediate transfer medium 17 after the secondary transfer so that a transfer image is obtained on the transfer medium. In addition, the toner particles remaining on the image bearing member 11 are retrieved into a toner collection room in the cleaner 14 by the cleaning blade 41 in the cleaner 14. In addition, the toner particles remaining on the intermediate transfer medium 17 after the secondary transfer are retrieved into the toner collection room in a belt cleaning device 19 by the cleaning blade in the belt cleaning device 19.

The image forming apparatus 100 illustrated in FIG. 8 is an image forming apparatus employing a tandem and intermediate transfer system in which the image formation portions 10 are arranged along the intermediate transfer medium 17. Multiple toner images having different colors sequentially formed on respective image bearing members 11 (11Y, 11M, 11C and 11K) by the image formation portions 10 are sequentially transferred to the intermediate transfer medium 17 followed by transferring of the image to a transfer medium such as paper at once. The transfer medium (recording medium) to which the toner image is transferred is transferred by a transfer device to a fixing device 40 where the toner is fixed upon application of heat, etc. The transfer medium after fixing is discharged to a discharging tray 70 by a transfer device 15 and a discharging roller. In addition, this image forming apparatus 100 has a duplex mode. In the duplex mode, the image forming apparatus 100 switches the transfer path downstream from the fixing device 40, reverses the transfer medium on which the image on one side is fixed back to front via a duplex transfer device 210 and re-feeds the transfer medium to the secondary transfer portion by the transfer roller and the registration roller to transfer an image to the rear side of the recording medium. The transfer medium after transferring of the image is transferred to the fixing device 40 where the image is fixed as described above and then discharged to the discharging tray 70 after fixing.

The image forming apparatus 100 may employ a tandem and direct transfer system in which no intermediate transfer medium is used while the other structures are the same as described above. In this direct transfer system, for example, a transfer belt that bears and transfers a transfer medium is used instead of the intermediate transfer medium. Multiple toner images of different colors sequentially formed on the respective image bearing members 11 (11Y, 11M, 11C and 11K) are directly transferred to a transfer medium such as paper that is transferred by the transfer belt and then to the fixing device 40 where toner is fixed upon application of heat, etc.

According to the image forming apparatus of the present disclosure, quality images can be formed for an extended period of time without producing defective images because the protective agent block of the present disclosure is used.

Embodiment 4

The image bearing member 11 suitably used in the image forming apparatus and the process cartridge of the present disclosure is described. The image bearing member (photoreceptor) 11 for use in the image forming apparatus of the present disclosure includes an electroconductive substrate on which a photosensitive layer is provided. The photosensitive layer is typified into a single layer type in which charge generation material and charge transport material are present in a mixed manner, a sequential layer order type in which a charge transport layer is formed on a charge generation layer, and a reverse layer order type in which a charge generation layer is formed on a charge transport layer. In addition, a protection layer can be provided on the photosensitive layer to improve the properties such as the mechanical strength, anti-abrasion property, anti-gas property, and cleaning property of the image bearing member 11. Furthermore, an undercoating layer is optionally provided between the photosensitive layer and the electroconductive substrate. In addition, an agent such as a plasticizer, an anti-oxidant, and a leveling agent can be added to each layer in a suitable amount.

The electroconductive substrate is made of material having a volume resistance of not greater than $10^{10}$ Ω·cm. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable. The substrate having a drum form preferably has a diameter of from 20 mm to 150 mm, more preferably from 24 mm to 100 mm and particularly preferably from 28 mm to 70 mm. When the diameter of the substrate having a drum form is too small, arrangement of devices performing processes of charging, irradiation, development, transfer, cleaning, etc. around the image bearing member tends to be physically difficult. A diameter that is too large is not preferred because it tends to result in an increase in the size of the image forming apparatus. In particular, when the image forming apparatus 100 employs a tandem type as illustrated in FIG. 8, multiple image bearing members 11 are installed so that the diameter is 70 mm at most and preferably 60 mm at most. In addition, endless nickel belts and endless stainless belts can be also used as the electroconductive substrate.

Materials for use in the undercoating layer of the image bearing member 11 for use in the image forming apparatus 100 are, for example, resins, mixtures mainly formed of white pigments and resins, an oxidized metal film formed by chemically or electrochemically oxidizing the surface of the electroconductive substrate. Among these, mixtures mainly formed of white pigments and resins are preferable. Specific examples of the white pigments include, but are not limited to, metal oxides such as titanium oxide, aluminum oxide, zirconium oxide, and zinc oxide. Among these, a white pigment containing titanium oxide is particularly preferable in terms of charge infusion prevention from the electroconductive substrate. Specific examples of the resins for use in the undercoating layer include, but are not limited to, thermoplastic resins such as polyamide, polyvinylalcohol, casein, methylcellulose and thermocuring reins such as acrylic, phenol, melamine, alkyd, unsaturated polyesters, and epoxy, and mixtures thereof.

Specific examples of the charge generation material of the photoreceptor for use in the image forming apparatus of the present invention include, but are not limited to, azo pigments such as monoazo-based pigments, bisazo-based pigments, trisazo-based pigments, and tetrakisazo-based pigments; organic-based pigments and dyes such as triaryl methane-based dye, thiazine-based dye, oxazine-based dye, xanthene-based dye, cyanine-based dye, styryl-based dye, pyrylium-based dye, quinacridone-based pigment, indigo-based pigment, perylene-based pigment, polycyclic quinone-based pigment, bisbenzimidazole-based pigment, indanthrone-based pigment, squarylium-baed pigment, and phthalocyanine-based pigment; and inorganic material such as selenium, selenium-arsenic, selenium-tellurium, cadmium-sulfide; zinc oxide; titanium oxide, and amorphous silicone. These can be used alone or in combination. The undercoating layer can have a laminate structure.

Specific examples of the charge transport material of the image bearing member (photoreceptor) for use in the image forming apparatus of the present disclosure include, but are not limited to, anthracene derivatives, pyrene derivatives, carbazole derivatives, tetrazole derivatives, metallocene derivatives, phenothiazine derivatives, pyrazolline derivatives, hydrazone derivatives, styryl derivatives, styryl hydrazone derivatives, enamine compounds, butadiene compounds, distyryl compounds, oxazole compounds, oxadiazole compounds, thiazole compounds, imidazole compounds, triphenyl amine derivatives, phenylene diamine derivatives, aminostilbene derivatives, and triphenyl amine derivatives. These can be used alone or in combination.

The resins for use in forming the photosensitive layer of the charge generation layer and the charge transport layer are insulative and known thermoplastic resins, thermocuring resins, photocuring resins and photoconductive resins. Specific examples of such resins include, but are not limited to, thermoplastic resins such as polyvinyl chloride, polyvinylidene chloride, copolymers of vinyl chloride and vinyl acetate, copolymers of vinyl chloride-vinyl acetate-maleic anhydride, copolymers of ethylene-vinyl acetate, polyvinyl butyral, polyvinyl acetal, polyester, phenoxy resins, (meth)acrylic resin, polystyrene, polycarbonate, polyarylate, polysulfone, polyether sulfone, and ABS resins; thermocuring resins such as phenol resins, epoxy resins, urethane resins, melamine resins, isocyanate resins, alkyd resins, silicone resins, and thermocyring acryl resins, polyvinyl carbazole, polyvinyl anthracene and polyvinyl pyrene. These can be used alone or in combination. When the charge transport layer forms the uppermost surface layer, a resin containing polycarbonate is used. Specific examples of anti-oxidization agents are as follows:

Monophenol Based Compound 2,6-di-t-butyl-p-cresol, butylized hydroxyl anisole, 2,6-di-t-butyl-4-ethylphenol, stearyl-β-(3,5-di-t-butyl-4-hydroxyphehyl)propionate, and 3-t-butyl-4-hydroxynisole.

Bisphenol Based Compound 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol).

Phenol Based Polymer 1,1,3-tris-(2-methyl-4-hydroxy-5-t-butylphenol)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'hydroxy-3'-t-butylphenyl)butylic acid]glycol ester, and tocophenols.

Paraphenylene Diamine

N-phenyl-N' isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine Hydroquinone 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Sulfide dilauryl-3,3-thiodipropionate, distearyl-3,3f-thiodipropionate, and ditetradecyle-3,3f-thiodipropionate.

Organic Phosphorous Compound triphenyl phosphine, tri(nonylphenyl)phosphine, tri(dinonylphenyl)phosphine, tricresyl phosphine, and tri(2,4-dibutylphenoxy)phosphine.

Known plasticizers, for example, dibutyl phthalate and dioctyl phthalate, can be used as the plasticizers. Its content is suitably from 0 to about 30 parts by weight based on 100 parts by weight of the binder resin.

A leveling agent is optionally added to the charge transport layer. Specific examples of the leveling agents include, but are not limited to, silicon oils such as dimethyl silicone oil and methylphenyl siliconeoil and polymers or oligomers having a perfluoroalkyl group in its side chain and its suitable content is from 0 to 1 part by weight based on 100 parts by weight of the binder resin.

The surface layer is provided to improve the mechanical strength, anti-abrasion property, anti-gas property, cleaning property of the image bearing member as described above. Polymers having a mechanical strength stronger than the photosensitive layer, and polymers in which inorganic fillers are dispersed are preferably used to form the surface layer. A thin uppermost surface layer causes no problem even without a charge transport power. However, when the thickness of the uppermost surface layer increases without having a charge transport power, problems tend to arise such that the sensitivity of the image bearing member deteriorates, the voltage increases after irradiation, and the residual voltage increases. Therefore, adding the charge transport material specified above to the surface layer or using a polymer having a charge transport power in the protection layer is preferred. Since the mechanical strength is significantly different between the photosensitive layer and the surface layer in general, when the uppermost protection layer is abraded and disappears, the photosensitive layer also disappears soon. Therefore, the surface layer is desired to have a sufficient thickness which is a thickness of from 0.01 μm to 12 μm, preferably from 1 μm to 10 μm, and more preferably from 2 μm to 8 μm. When the layer thickness of the surface layer is too thin, part of the surface layer is easily abraded with the cleaning blade and disappears and thus the photosensitive layer is abraded in an accelerated manner from the disappeared portion. When the layer thickness of the surface layer is too thick, the photosensitivity tends to deteriorate and the voltage after irradiation and the residual voltage tend to rise. This should be avoided particularly when a polymer having a charge transport power is used in terms of cost.

Since a material transparent to writing light, and having excellent insularity, mechanical strength and adhesiveness is preferable as the polymer for use in the surface layer, polycarbonate is used in the uppermost layer of the image bearing member.

Particulates of metal or metal oxide are optionally dispersed in the surface layer to improve the mechanical strength thereof. Specific examples of the metal oxides include, but are not limited to, alumina, titanium oxide, tin oxide, potassium titanate, $TiO_2$, TiN, zinc oxide, indium oxide, and anthimony oxide. Fluorine resins such as polytetrafluoroethylene, silicone resins, or a mixture in which inorganic material is dispersed in these resins can be added to improve the anti-abrasion property.

The image bearing member is described as the photoreceptor in the embodiments described above. However, the image bearing member relating to the present disclosure can be an intermediate transfer medium for use in image formation according to the intermediate transfer system in which a toner image formed on the photoreceptor is primarily transferred to overlap color images and the overlapped color image is transferred to a transfer medium.

The intermediate transfer medium is preferably electroconductive with a voltage resistance of from $1.0\times10^5$ to $1.0\times10^{11}$ Ω·cm. A volume resistance that is too low may cause discharging, which leads to disturbance of formation of a toner image when the toner image is transferred from the image bearing member to the intermediate transfer body. When the volume resistance is too large, the charges to the toner image tend to remain on the intermediate transfer body which may appear on the next images as an accidental image after the toner image is transferred from the intermediate transfer body to a recording medium such as paper. The intermediate transfer medium is preferably electroconductive with a surface resistance of from $1.0\times10^8$ to $1.0\times10^{13}$ Ω/sq. A surface resistance that is too low tends to cause problems such that toner images are disturbed and transfer dust may be produced. A surface resistance that is too high tends to cause a problem such that performance of the primary transfer deteriorates.

Plastic etc., having a belt form or a cylinder form that is manufactured by, for example, mixing and kneading metal oxide such as tin oxide or indium oxide, or electroconductive particles or electroconductive polymers alone or in combination with a thermoplastic resins followed by extraction can be used as the intermediate transfer medium. An intermediate transfer medium having an endless form can be manufactured by optionally adding the electroconductive particles or electroconductive polymers to a liquid resin containing cross-linking reactive monomers or oligomers and centrifugal molding while heating.

When the surface layer is provided to the intermediate transfer medium, a component excluding the charge transport material from the material for the surface layer for use in the surface layer of the photoreceptor thereof can be used after the resistance of the component is adjusted using an electroconductive material in combination on a suitable basis.

Embodiment 5

The toner suitably used for the image forming apparatus 100 and the process cartridge 10C of the present disclosure is described next.

The toner for use in the image forming apparatus of the present disclosure preferably has an average circularity of from 0.93 to 1.00. In the present disclosure, the circularity is defined as the value obtained from the following relationship (2): The (average) circularity is an indicator of the concavo-convex degree of toner particles and a toner particle having perfect sphere has a circularity of 1.00. As the complexity of the surface form of a toner particle increases, the toner particle has a small circularity value.

Circularity $SR$=(length of the circumference of a circle having the same area as that of the projected image of a particle)/(length of the circumference of the projected image of the particle) Relationship (2).

When the average circularity is from 0.93 to 1.00, the surface of the toner particle is smooth and the contact area between toner particles, and toner particles and the image bearing member is small so that the transferability of the toner is good. In addition, since such toner particles have no angled (pointing) portion, the stirring torque of the development agent in the development device is small and driving for the stirring is stable, which leads to no production of abnormal images. In addition, since no angular toner particles are contained in particles that form dots, when the toner particles are pressed against a recording (transfer) medium during the transfer process, the pressure is uniformly applied to the toner particles, which prevents formation of hollow portions. In addition, since the toner particle is not angular, the toner particle itself hardly grinds, or damages or abrades the surface of the image bearing member.

The measuring method of the circularity is described. The circularity can be measured by a flow type particle image analyzer FPIA-1000 manufactured by SYSMEX CORPORATION. The specific procedure for obtaining the average circularity is as follows: (1) A surface active agent serving as a dispersion agent, preferably 0.1 ml to 5 ml of an alkylbenzenesulfonic acid salt, is added to 100 ml to 150 ml of water from which solid impurities have been preliminarily removed; (2) About 0.1 to about 0.5 g of a sample to be measured is added into the mixture prepared in (1); the liquid suspension in which the sample is dispersed is subjected to an ultrasonic dispersion treatment for about 1 minute to about 3 minutes such that the concentration of the particles is 3,000 particles per microliter to 10,000 particles per microliter; and the form and particle size of the toner are measured using the instrument mentioned above.

The toner for use in the image forming apparatus of the present disclosure preferably has a weight average particle diameter D4 of from 3 μm to 10 μm in addition to the circularity described above. In this range, the dot representability is excellent because toner particles have a particle diameter sufficiently small in comparison with a minute latent image dot. A weight average particle diameter D4 that is too small easily causes problems of deterioration of transfer efficiency and blade cleaning property. Reducing scattering of texts or lines is difficult when a weight average particle diameter D4 that is too large is used.

The toner for use in the present disclosure has a ratio (D4/D1) of the weight average particle diameter D4 to the number average particle diameter D1 is preferably from 1.00 to 1.40. As the ratio of D4/D1 approaches to 1, the toner has a sharper particle size distribution. Therefore, when the ratio (D4/D1) is in the range of from 1.00 to 1.40, the quality of images is stable because the selective development phenomenon ascribable to the toner particle diameter is avoided. In addition, since the particle size distribution of the toner is sharp, the distribution of the amount of friction charge is also sharp, which leads to prevention of occurrence of fogging. Furthermore, in the case of toner particles having diameter sizes within a small range, latent image dots are developed in an orderly and densely arranged manner, which leads to excellent dot reproducibility.

The measuring method of the particle size distribution of toner particles is described. Coulter Counter TA-II and Coulter Multisizer II (both are manufactured by Beckman Coulter, Inc.), etc. can be used as the measuring equipment in Coulter counter method. The measuring method is as follows.

First, add 0.1 ml to 5 ml of a surface active agent (preferably alkyl benzene sulfonate salt) as a dispersant to 100 ml to 150 ml of an electrolytic aqueous solution, which is about 1% NaCl aqueous solution prepared by using primary NaCl and pure water, for example, ISOTON-II (manufactured by Beckman Coulter, Inc.) can be used; Add 2 mg to 20 mg of a measuring sample; Conduct dispersion treatment for the electrolytic aqueous solution in which the measuring sample is dispersed for about 1 minute to 3 minutes by an ultrasonic dispersion device; Measure the volume and the number of the toner particles or the toner by the equipment mentioned above with an aperture of 100 μm; and calculate the volume distribution and the number distribution. The weight average particle diameter (D4) and the number average particle diameter (D1) of the toner can be obtained according to the obtained distribution.

The whole range is a particle diameter of from 2.00 to less than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to less than 40.30 μm.

The toner having such a significantly round form is preferably manufactured by cross-linking and/or elongating reaction of toner compositions containing a polyester prepolymer having a functional group having a nitrogen atom, a polyester, a coloring agent, and a releasing agent in an aqueous medium under the presence of resin particulates. The toner prepared in this reaction can reduce the occurrence of hot offset by hardening the surface of the toner, which results in reduction of contamination of the fixing device and its reflection on images.

An example of the prepolymer formed of a modified polyester based resin for use in manufacturing toner is a polyester prepolymer (A) having an isocyanate group and an example of the compound that elongates or cross-links with the prepolymer is an amine (B).

The polyester prepolymer (A) mentioned above can be prepared by, for example, reacting a polyester having an active hydrogen group, which is a polycondensation product of a polyol (1) and a polycarboxylic acid (2), with a polyisocyanate (3). Specific examples of the active hydrogen group contained in the polyester mentioned above including the mentioned above include, but are not limited to, hydroxyl groups (alcohol hydroxyl groups and phenol hydroxyl groups), amino groups, carboxylic groups, and mercarpto groups. Among these, alcohol hydroxyl groups are particularly preferred.

Examples of the polyol (1) are diol (1-1) and polyol (triol or higher polyol) (1-2) and using diol (1-1) or a mixture of diol (1-1) with a small amount of (1-2) is preferred. Specific examples of the diols (1-1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc. Among these compounds, alkylene glycols having 2 to 12 carbon atoms and adducts of a bisphenol with an alkylene oxide are preferable. Adducts of bisphenol with an alkylene oxide and mixtures of an adduct of a bisphenol with an alkylene oxide and an alkylene glycol having 2 to 12 carbon atoms are particularly preferable. Specific examples of the polyols (1-2) include, but are not limited to, fatty acid alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Specific examples of suitable polycarboxylic acids (2) include, but are not limited to, dicarboxylic acids (2-1) and polycarboxylic acids (2-2) having three or more carboxyl groups. Among these, using the dicarboxylic acid (2-1) alone or a mixture of the dicarboxylic acid (2-1) with a small amount of polycarboxylic acid (2-2) is preferred.

Specific examples of the dicarboxylic acids (2-1) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids; etc.) Among these compounds, alkenylene dicarboxylic acids having 4 to 20 carbon atoms and aromatic dicarboxylic acids having 8 to 20 carbon atoms are preferably used.

Specific examples of the polycarboxylic acids (2-2) having three or more hydroxyl groups include, but are not limited to, aromatic polycarboxylic acids having from 9 to 20 carbon atoms (e.g., trimellitic acid and pyromellitic acid). In addition, compounds prepared by reaction between anhydrides or lower alkyl esters (e.g., methyl esters, ethyl esters or isopropyl esters) of the polycarboxylic acids mentioned above and polyols (1) can be used as the polycarboxylic acid (2).

A suitable mixing ratio (i.e., an equivalence ratio [OH]/[COOH]) of a polyol (1) to a polycarboxylic acid (2) is from 2/1 to 1/1, preferably from 1.5/1 to 1/1, and more preferably from 1.3/1 to 1.02/1.3.

Specific examples of the polyisocyanates (3) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination.

Suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner tends to deteriorate. When the molar ratio of [NCO] is too small, the urea content of urea-modified polyesters in the modified polyesters tends to be small, which leads to deterioration of the hot offset resistance. The content ratio of the constitutional component of a polyisocyanate (PIC) (3) in the polyester prepolymer (A) having a polyisocyanate group at its end portion is from 0.5 to 40% by weight, preferably from 1% to 30% by weight and more preferably from 2% to 20% by weight. A ratio of the polisocyanate (3) that is too small, for example, less than 0.5%, tends to degrade the hot offset resistance and prevent to have a good combination of the high temperature preservability and the low temperature fixing property. In contrast, when the content ratio is too high, the low temperature fixability of the toner tends to deteriorate.

The number of isocyanate groups included in the prepolymer (A) per molecule is normally not less than 1, preferably from 1.5 to 3, and more preferably from 1.8 to 2.5. When the number of isocyanate groups is too small, the molecular weight of urea-modified polyester tends to be small and thus the hot offset resistance easily deteriorates.

Specific examples of the amines (B) include, but are not limited to, diamines (B1), polyamines (B2) having three or more amino groups, amino alcohols (B3), amino mercaptans (B4), amino acids (B5), and blocked amines (B6) in which the amines (B1-B5) mentioned above are blocked. Specific examples of the diamines (B1) include, but are not limited to, aromatic diamines (e.g., phenylene diamine, diethyltoluene diamine, and 4,4f-diaminodiphenyl methane); alicyclic diamines (e.g., 4,4f-diamino-3,3f-dimethyldicyclohexyl methane, diaminocyclohexane and isophoron diamine); aliphatic diamines (e.g., ethylene diamine, tetramethylene diamine, and hexamethylene diamine); etc. Specific examples of the polyamines (B2) having three or more amino groups include, but are not limited to, diethylene triamine, and triethylene tetramine. Specific examples of the amino alcohols (B3) include, but are not limited to, ethanol amine and hydroxyethyl aniline. Specific examples of the amino mercaptan (B4) include, but are not limited to, aminoethyl mercaptan and aminopropyl mercaptan. Specific examples of the amino acids (B5) include, but are not limited to, amino propionic acid and amino caproic acid. Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc. Among these, (B1) and a mixture of (B1) with a small amount of (B2) are preferred.

Furthermore, the molecular weight of the urea-modified polyesters can be adjusted by using a molecular weight control agent. Specific examples of the molecular weight control agent include, but are not limited to, monoamines (e.g., diethyl amine, dibutyl amine, butyl amine and lauryl amine) having no active hydrogen group, and blocked amines (i.e., ketimine compounds) prepared by blocking the monoamines mentioned above.

The mixing ratio of the isocyanate group to the amines (B), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1.5/1.2. When the mixing ratio is too large or too small, the molecular weight of the resultant urea-modified polyester (i) decreases, resulting in deterioration of the hot offset resistance of the resultant toner. In the present disclosure, the urea-modified polyester (i) may contain a urethane bonding in addition to the urea bonding. The molar ratio of the content of the urea bonding to the content of the urethane bonding is from 100/0 to 10/90, preferably from 80/20 to 20/80 and more preferably from 60/40 to 30/70. When the molar ratio of the urea bonding is too small, the anti-hot offset property tends to deteriorate.

By the reaction specified above, modified polyesters for use in the toner, particularly, the urea-modified polyester (i) is manufactured. This urea-modified polyester (i) is manufactured by the one-shot method or a prepolymer method. The weight average molecular weight of the urea-modified polyester (i) is 10,000 or higher, preferably from 20,000 to 10,000,000, and more preferably from 30,000 to 1,000,000. When the weight average molecular weight is too small, the anti-hot offset property tends to deteriorate. The number average molecular weight of the urea-modified polyester is not particularly limited when an unmodified polyester (ii), which is described later, is used. The number average molecular weight is controlled to obtain the weight average molecular weight within the range specified above. When the polyester (i) is singly used, the number average molecular weight is 20,000 or lower, preferably from 1,000 to 10,000, and more preferably from 2,000 to 8,000. When the number average molecular weight is too large, the low temperature fixability of the resultant toner tends to deteriorate, and in addition the gloss of full color images degrades when the toner is used in a full color image forming apparatus.

With regard to the toner related to the present invention, a combination of the urea-modified polyester (i) with an unmodified polyester (ii) as the component of a binder resin can be used as well as the single usage of the urea-modified polyester (i). This combinational use of (i) and (ii) is more preferable to the single use of (i) in terms of improvement on the low temperature fixability of a toner and the gloss property when the toner is used in a full-color image forming apparatus. Examples of the polyester (ii) are polycondensation products formed of the polyol (1) and the polycarboxylic acid (2) which have the same polyester component specified for the modified polyester (i) and preferred examples are the same as those for the modified polyester (i). In addition, a polyester modified by a bonding (e.g., urethane bonding) other than urea bonding can be used as the polyester (ii) in addition to unmodified polyesters. The polyester (i) and the polyester (ii) that are at least partially compatible in each other are preferable in terms of the low temperature fixing property and the anti-hot offset property. Therefore, the polyester (ii) preferably has a component similar to the polyester component of the polyester (i). The weight ratio of the polyester (i) to the polyester (ii) is from 5/95 to 80/20, preferably from 5/95 to 30/70, more preferably from 5/95 to 25/75 and particularly preferably from 7/93 to 20/80 when the polyester (ii) is contained. A ratio of the polyester (i) that is too small, for example, less than 5%, tends to degrade the hot offset resistance and be disadvantageous to have a good combination of the high temperature preservability and the low temperature fixing property.

The peak molecular weight of the polyester (ii) is from 1,000 to 30,000 and preferably from 1,500 to 10,000 and more preferably from 2,000 to 8,000. When the peak molecular weight is too small, the high temperature preservability tends to deteriorate. When the peak molecular weight is too large, the low temperature fixing property tends to deteriorate. The hydroxyl value of the polyester (ii) is preferably 5 or higher, more preferably from 10 to 120, and further preferably from 20 to 80. A hydroxyl value that is too small may be disadvantageous in terms of having a good combination of the high temperature preservability and the low temperature fixing property. The acid value of the polyester (ii) is from 1 to 30 and preferably from 5 to 20. The polyester (ii) having an acid value tends to cause the resultant toner to have a negative charging property.

The glass transition temperature (Tg) of the binder resin in the toner related to the present invention is preferably from 50° C. to 70° C. and more preferably from 55° C. to 65° C. A toner that has an excessively low glass transition temperature easily causes blocking when the toner is preserved at a high temperature. When the glass transition temperature is too high, the low temperature fixing property tends to deteriorate. The dry toner for use in the present invention tends to have a relatively good high temperature preservability due to the presence of the urea-modified polyester resins even when the dry toner has a low glass transition temperature when compared with a known polyester based toner. With respect to the storage elastic modulus of the toner binder resin, the temperature (TG') at which the storage elastic modulus is 10,000 dyne/cm2 when measured at a frequency of 20 Hz is not lower than 100° C., and preferably from 110 to 200° C. When t the temperature (TG') is too low, the anti-hot offset property tends to deteriorate. With respect to the viscosity of the toner binder resin, the temperature (Tη) at which the viscosity is 1,000 poise when measured at a frequency of 20 Hz is not higher than 180° C. and preferably from 90 to 160° C. When the temperature (Tη) is too high, the low temperature fixability of the toner tends to deteriorate. In order to achieve a good combination of the low temperature fixability and the hot offset resistance, the TG' is preferably higher than the Tη. Specifically, the difference (TG'−Tη) is preferably not less than 0° C., more preferably not less than 10° C., and furthermore preferably not less than 20° C. The difference particularly has no specific upper limit. In order to achieve a good combination of the high temperature preservability and the low temperature fixability, the difference (Tη−Tg) is preferably from 0° C. to 100° C., more preferably from 10° C. to 90° C. and furthermore preferably from 20° C. to 80° C.

The binder resin (toner binder) is manufactured by the following method, etc. Heat the polyol (1) and the polycarboxylic acid (2) to 150 to 280° C. under the presence of known esterification catalysts such as tetrabuthoxy titanate, dibutyl tin oxide, etc.; remove produced water with a reduced pressure, if necessary, to obtain a polyester having a hydroxyl group; react the polyester with the polyisocyanate (3) at 40 to 140° C. to obtain the prepolymer (A) having an isocyanate group; and furthermore, conduct reaction between the prepolymer (A) and the amine (B) at 0 to 140° to obtain a urea-modified polyester. During the reaction of the polyisocyanate (3) and the prepolymer (A) and the amine (B), a solvent is optionally used. Examples of such solvents are inert compounds to the isocyanate (3) and specific examples thereof include, but are not limited to, inert compounds to the isocyanate (3) such as aromatic solvents (toluene, xylene); ketones (acetone, methylethyl ketone, methylisobutyl ketone); esters (ethyl acetate); amides (dimethylformamide, dimethylacetamide); and ethers (tetrahydrofuran). When the polyester (ii) which is not modified by urea bonding is used in combination, the polyester (ii) is prepared by the same method as for the polyester having a hydroxyl group and dissolved in and mixed with the solution of the polyester (i) after the reaction.

The toner for use in the present invention can be manufactured by the following method but this is not limiting.

Suitable aqueous media for use in the present invention include water, and a mixture of water with a solvent which is mixable with water. Specific examples of such a solvent include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The toner particles can be prepared by reacting a dispersion body formed of the prepolymer (A) having an isocyanate group with the amine (B) in an aqueous medium or using a preliminarily manufactured urea modified polyester (i). The dispersion body formed of the urea-modified polyester (i) or the prepolymer (A) in an aqueous medium can be stably formed by, for example, a method in which a composition of toner material containing the urea-modified polyester (i) and the prepolymer (A) is added to the aqueous medium and dispersed by shearing force. The prepolymer (A) and other toner compositions (also referred to as toner material) such as a coloring agent, a coloring agent master batch, a releasing agent, a charge control agent, and an unmodified polyester resin can be mixed in an aqueous medium when forming a dispersion body. However, a method in which toner material is preliminarily mixed and then the mixture is added to and dispersed in an aqueous medium is preferable. In addition, in the present invention, a coloring agent, a releasing agent, and a charge control agent, etc. are not necessarily mixed when particles are formed in an aqueous medium but can be added after particles are formed in an aqueous medium. For example, after particulates containing no coloring agent are formed, a coloring agent is added thereto by a known dying method.

There is no particular limit to the dispersion method. Low speed shearing methods, high speed shearing methods, friction methods, high pressure jet methods, ultrasonic methods, etc., can preferably be used. Among these methods, the high speed shearing method is preferable because a dispersion body having a particle diameter of from 2 to 20 μm can be easily prepared. When a high speed shearing type dispersion machine is used, there is no particular limit to the rotation speed thereof, but the rotation speed is typically from 1,000 to 30,000 rpm, and preferably from 5,000 to 20,000 rpm. There is no specific limit to the dispersion time but the dispersion time is typically from 0.1 minutes to 5 minutes in the batch system. The temperature during the dispersion process is typically from 0° C. to 150° C. (under pressure), and preferably from 40° C. to 98□. A high temperature is preferable during the dispersion process because the viscosity of the dispersion body containing the urea-modified polyester (i) and the prepolymer (A) is low in a high temperature, which is advantageous to perform easy dispersion.

The content of the aqueous medium is typically from 50 parts by weight to 2,000 parts by weight and preferably from 100 parts by weight to 1,000 parts by weight based on 100 parts by weight of the toner component including the urea-modified polyester (i) and the prepolymer (A). When the amount of an aqueous medium is too small, the dispersion stability of the toner composition is degraded so that toner particles having a desired particle diameter are not obtained. In contrast, a ratio of the aqueous medium that is too large is not preferred in terms of the economy. A dispersion agent can be optionally used. The particle size distribution is sharp and dispersion is stabilized when a dispersion agent is used.

In the process in which the urea-modified polyester (i) is synthesized from the prepolymer (A), the amine (B) can be added to an aqueous medium before the toner component is dispersed therein, or to a liquid dispersion in which the toner component is dispersed in an aqueous medium to start reaction at the particle interface. In the latter case, the urea-modified polyester is preferentially formed at the surface portions of the toner particles. Thus, a gradient of the concentration of the urea-modified polyester can be made in the thickness direction of the toner particle.

Specific examples of dispersion agents to emulsify and disperse an oil phase in which the toner component is dispersed in liquid containing water include, but are not limited to, anionic surface active agents such as; alkylbenzene sulfonic acid salts, α-olefin sulfonic acid salts, and phosphoric acid esters; cationic surface active agents such as amine salt type surface active agents such as alkyl amine salts, amino alcohol fatty acid derivatives, polyamine fatty acid derivatives, and imidazoline, and quaternary ammonium salt type anionic surface active agents such as alkyl trimethyl ammonium salts, dialkyl dimethyl ammonium salts, alkyl dimethyl benzyl ammonium salts, pyridinium salts, alkyl isoquinolinium salts, and benzetonium chloride; and nonionic surface active agents such as amopholytic surface active agents such as alanine, dodecyldi(amino ethyl)glycine, di(octyl amonoethyl)glycine, and N-alkyl-N,N-dimethyl ammonium betaine.

An extremely small amount of a surface active agent having a fluoroalkyl group is effective for a good dispersion. Preferred specific examples of the anionic surface active agents having a fluoroalkyl group include, but are not limited to, fluoroalkyl carboxylic acids having from 2 to 10 carbon atoms and their metal salts, disodium perfluorooctanesulfonyl glutamate, sodium 3-{omega-fluoroalkyl(C6-C11)oxy}-1-alkyl(C3-C4)sulfonate, sodium 3-{omega-fluoroalkanoyl (C6-C8)-N-ethylamino}-1-□propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents including but are not limited to, primary, secondary and tertiary fatty acid amines having a fluoroalkyl group, fatty acid quaternary ammonium salts such as perfluoroalkyl (having 6 to 10 carbon atoms) sulfoneamide propyltrimethyl ammonium salts, benzalkonium salts, benzetonium chloride, pyridinium salts and imidazolinium salts. Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

An inorganic compound such as tricalcium phosphate, calcium phosphate, titanium oxide, colloidal silica, and hydroxyapatite can also be used as the inorganic compound dispersant hardly soluble in water. Liquid droplet dispersion can be stabilized in an aqueous medium by using a polymer protection colloid. Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine). In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protection colloid.

When compounds, for example, calcium phosphate, which are soluble in an acid or alkali, are used as a dispersion stabilizer, it is possible to dissolve the calcium phosphate by adding an acid, for example, hydrochloric acid, followed by washing of the resultant particles with water, to remove the calcium phosphate from the particulates. In addition, a zymolytic method can be used to remove such compounds. Such a dispersion agent may remain on the surface of toner particles. However, the dispersion agent is preferably washed and removed after elongation and/or cross-linking reaction in terms of the charging property of toner particles.

In addition, a solvent in which the urea-modified polyester (i) or the prepolymer (A) is soluble can be used to decrease the viscosity of the toner component. It is preferable to use a solvent to obtain a sharp particle size distribution. Also, a volatile solvent is preferable because the solvent can be easily removed from liquid dispersion after the particles are formed. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These can be used alone or in combination. Among these solvents, aromatic solvents such as toluene and xylene; and halogenated hydrocarbons such as methylene chloride, 1,2-dichloroethane, chloroform, and carbon tetrachloride are preferably used. The aromatic solvents such as Toluene and xylene are more preferable. The addition amount of such a solvent is from 0 to 300 parts by weight, preferably from 0 to 100 parts by weight, and more preferably from 25 to 70 parts by weight, based on 100 parts by weight of the prepolymer (A). When such a solvent is used, the solvent is removed therefrom upon application of heat thereto under a normal or reduced pressure after the elongation reaction and/or a crosslinking reaction of the particles.

The crosslinking time and/or the elongation time is determined depending on the reactivity determined according to the combination of the isocyanate group structure of the prepolymer (A) and the amine (B) and is typically from 10 minutes to 40 hours, and preferably from 2 to 24 hours. The reaction temperature is from 0 to 150° C. and preferably from 40 to 98° C. Any known catalyst can be used in the elongation reaction and/or cross linking reaction, if desired. Specific examples thereof include, but are not limited to, dibutyltin laurate, and dioctyltin laurate.

In order to remove the organic solvent from the thus prepared emulsion dispersion body, a method is used in which the temperature of the emulsion is gradually raised to completely evaporate and remove the organic solvent in the droplets dispersed in the emulsion. Alternatively, a drying method in which the emulsion is sprayed in a dry atmosphere to completely evaporate and remove not only the non-water-soluble organic solvent but also the remaining aqueous medium in the drops in the emulsion to form toner particulates can be used. The dry atmosphere can be prepared by heating gases, for example, air, nitrogen, carbon dioxide and combustion gases. The temperature of the heated gases is preferred to be higher than the highest boiling point of all of the solvents in the emulsion dispersion body. The drying treatment in a short period of time with a drying device such as a spray dryer, a belt dryer, a rotary kiln, etc. is sufficient to obtain desired quality.

When the thus prepared toner particles have and maintain a wide particle size distribution after the washing and drying treatment of the particles, the particle size distribution can be adjusted by a classification treatment to obtain a desired particle size distribution. The classification treatment can be performed in a liquid dispersion using a cyclone, a decanter, or a centrifugal to remove fine particles therefrom. Classification treatment can be performed for powder of the toner particles obtained after drying but classification in the liquid including the particles is preferable in terms of the efficiency. Obtained toner particulates or coarse particles can be returned to the mixing and kneading process for reuse even when the toner particulates or coarse particles are in a wet condition. Removing the dispersion agent from the liquid dispersion as much as possible is preferable and is preferably conducted together with the classification process described above.

The toner powder obtained after drying can be mixed with other fine particles such as release agent particles, charge control agent particles, fluidizing agent particles and coloring agent particles. Such mixed fine particles can be fixed and fused on the surface of the toner particles by applying a mechanical impact thereto. Thus, the fine particles can be prevented from being detached from the surface of the thus obtained complex particles. Specific examples of such mechanical impact application methods include, but are not limited to, methods in which an impact is applied to the mixture by a blade rotating at a high speed and methods in which the mixture is put into a jet air to collide the particles against each other or the complex particles into a suitable collision plate. Specific examples of such mechanical impact applicators include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

Known pigments and dyes used as coloring agents for toner can be used and specific examples thereof include, but are not limited to, carbon black, lamp black, black iron oxide, indigo, Nigrosine dyes, aniline blue, phthalocyanine blue, phthalocyanine green, Hansa Yellow GR, rhodamine 6C lake, Calco oil blue, chrome yellow, Quinacridone Red, Benzidine yellow, and rose Bengal. These can be used alone or in combination.

The toner can have magnetic characteristics optionally in the toner by containing magnetic components of iron oxides such as ferrite, magnetite, maghematite, metals such as iron, cobalt, and nickel, alloyed metals thereof with other metals or mixtures thereof. These magnetic components can be also used as coloring agent components or in combination with other coloring agents.

The number average particle diameter of the coloring agent in the toner for use in the present invention is preferably from 0.5 μm or smaller, more preferably from 0.4 μm or smaller, and from 0.3 μm or smaller. When the number average particle diameter is excessively large, the dispersion property of the pigment tends to be insufficient so that desirable transparency might not be obtained. Coloring agent particles having a number average particle diameter smaller than 0.1 μm is sufficiently small in comparison with a half wavelength of optical light and is thus considered to have no adverse impact on the reflectivity or absorption characteristics of light. Therefore, coloring agent particles having a number average particle diameter smaller than 0.1 μm contributes to improve color reproducibility and transparency for a transparent sheet having a fixed image thereon. On the other hand, when coloring agent particles having ab excessively large number average particle diameter, for example, greater than 0.5 μm, are contained in a large amount, the incident light tends to hardly transmit or be easily scattered so that the lightness and the colorness of projected images of transparent sheets tend to deteriorate. Furthermore, the coloring agent is easily detached from the surface of the toner particle, which leads to problems such as fogging, contamination of the drum, bad cleaning performance. The content ratio of coloring agents having a number average particle diameter greater than 0.7 μm is preferably not greater than 10% by number and more preferably not greater than 5% by number.

In addition, when the coloring agent is preliminarily mixed and kneaded with part or all of binder resin and a preliminarily added moistening liquid, the binder resin and the coloring agent are sufficiently attached to each other at the initial stage. The coloring agent is effectively dispersed in the toner particles in the following toner manufacturing process and the dispersion particle diameter of the coloring agent decreases so that further suitable transparency is obtained. The binder resins specified above used as the binder resins for toner are used as the binder resins for use in preliminary kneading and mixing but the binder resins for use in preliminary kneading and mixing are not limited thereto.

A specific method of preliminarily mixing and kneading the mixture of the binder resin and a coloring agent together with a moistening liquid is to: mix a binder resin, a coloring agent, moistening liquid by a blender such as HENSCEL MIXER; and mix and knead the obtained mixture with a kneader such as a two-roll or a three-roll at a temperature lower than the melting point of the binder resin to obtain a sample. In addition, typical known liquid can be used as the moistening liquid considering the solubility of the binder resin and the wettability of the coloring agent. Organic solvents such as acetone, toluene, and butanone, and water are preferred in terms of the dispersion property of the coloring agent. Among these, the usage of water is particularly preferred in consideration of environment, and maintenance of dispersion stability of the coloring agent in the toner manufacturing process thereafter. According to this method, the particle diameter of the coloring agent particles contained in the obtained toner decreases and in addition the uniformity of the dispersion status of the particles increases. Therefore, the color reproducibility of a projected image on a transparent sheet is further improved.

In the toner, a releasing agent (represented by wax) is preferably contained in addition to the binder resin and the coloring agent. Any known releasing agent can be suitably used. Specific examples of the release agent (wax) include, but are not limited to, polyolefin waxes such as polyethylene waxes and polypropylene waxes; long chain hydrocarbons such as paraffin waxes and SAZOL waxes; waxes including a carbonyl group, etc.

Among these waxes, the waxes including a carbonyl group are particularly preferable. Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc.

Among these materials, the polyalkane acid esters are preferable. The releasing agent preferably has a melting point of from 40 to 160° C., more preferably from 50 to 120° C., and furthermore preferably from 60 to 90° C. Wax having an excessively low melting point tends to have an adverse impact on the high temperature preservation property, and wax having an excessively high melting point tends to cause cold offset during fixing at a low temperature. The releasing agent preferably has a melt viscosity of from 5 to 1000 cps and more preferably from 10 to 100 cps at a temperature 20° C. higher than the melting point of the releasing agent. A wax having an excessively high melt viscosity scarcely improves anti-hot offset property or low temperature fixing property. The content of the wax in the toner is from 0 to 40% by weight and preferably from 3 to 30% by weight based on the toner.

Also, the toner can optionally contain a charge control agent to improve the charging and quicken the rise thereof. A charge control agent formed of colored material changes color of the toner. Therefore, the charge control agent is preferably made of transparent material or material having a white color or a color close thereto. Any known charge control agent can be used. Specific examples thereof include, but are not limited to, triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives. Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, and a quaternary ammonium group.

The content of the charge control agent is determined depending on the kind of the binder resin, whether or not an additive is optionally added and the toner manufacturing method (including the dispersion method), and thus is not unambiguously defined. However, the content of the charge control agent is preferably from 0.1 to 10 parts and more preferably from 0.2 to 5 parts by weight, based on 100 parts by weight of the binder resin. A content that is excessively large tends to lead to excessive charging property to the toner, which results in a decrease in the effect of the charge controlling agent, an increase in an electrostatic attraction force between a development roller and the toner, reduction of the fluidity of the development agent (toner), and a decrease in the image density. The charge control agent can be dissolved or dispersed in an organic solvent after the charge control agent is kneaded together with a master batch pigment and resin. In addition, the charge control agent can be directly dissolved or dispersed in an organic solvent when the toner component is dissolved or dispersed in an organic solvent. Alternatively, the charge control agent may be fixed on the surface of the toner particles after the toner particles are prepared.

In addition, resin particulates can be optionally added to stabilize dispersion when the toner component is dispersed in an aqueous medium in the toner manufacturing process. Any resins that forms an aqueous dispersion body. can be used as the resin particulates. Specific examples of these resins include, but are not limited to, thermoplastic resins or thermosetting (thermocuring) resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These can be used alone or in combination. Among these resins, vinyl resins, polyurethane resins, epoxy resins, polyester resins, and mixtures thereof are preferably used because an aqueous dispersion body including fine spherical particulates can be easily prepared.

Specific examples of the vinyl resins include, but are not limited to, polymers prepared by polymerizing or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

Inorganic particulates are suitable as an external additive to assist the fluidity, the developability and the charging property of toner particles. Such inorganic particulates preferably have a primary particle diameter of from 5 nm to 2 μm, and more preferably from 5 nm to 500 nm. In addition, it is preferred that the specific surface area of such inorganic particulates measured by the BET method is from 20 $m^2/g$ to 500 $m^2/g$. The content ratio of such inorganic particulates is preferably from 0.01% to 5% by weight and particularly preferably from 0.01% to 2% by weight based on the weight of toner, Specific examples of the inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, other polymer particulates such as polymers and copolymers of styrene, methacrylates, acrylates or the like prepared by a soap-free emulsion polymerization method, a suspension polymerization method or a dispersion polymerization method and polymer particles of polycondensation or thermocuring resins such as silicone resins, benzoguanamine resins and nylon resins can also be used as the external additive.

The external additives such as a fluidizer can be surface-treated to improve the hydrophobic property and prevent deterioration of the fluidity characteristics and chargeability in a high humidity environment. Preferred specific examples of surface treatment agents include, but are not limited to, silane coupling agents, silyl agents, silane coupling agents having a fluorine alkyl group, organic titanate coupling agents, aluminum-based coupling agents, silicone oil, and modified-silicone oil.

The toner for use in the present invention may include a cleaning improver to remove the toner (development agent) remaining on an image bearing member such as a photoreceptor and an intermediate transfer body. Specific examples of the cleaning improvers include, but are not limited to, zinc stearate, calcium stearate and metal salts of fatty acid acids such as stearic acid; polymer particulates such as polymethyl methacrylate particulates and polystyrene particulates, which are prepared by a soap-free emulsion polymerization method or the like, etc. Such polymer particulates preferably have a relatively sharp particle size distribution and a volume average particle size of from 0.01 to 0.01 μm.

Quality toner images can be formed with the stable developability as described above by using such toner. However, toner remaining on an image bearing member without being transferred to a transfer medium or an intermediate transfer medium by a transfer device is difficult to remove by a cleaning device because of the minuteness or rolling property of the toner and may pass through the cleaning device. Strongly pressing a toner removing member such as a cleaning blade against an image bearing member is required to completely remove the toner from the image member. Such pressure causes the working life of the image bearing member and the cleaning device to be short and consumes extra energy. When the pressure to the image bearing member is relaxed, toner and a carrier having a small particle diameter on the image bearing member is not completely removed. These damage the surface of the image bearing member when passing through the cleaning device, thereby fluctuating the performance of the image forming apparatus.

As described above, the image forming apparatus of the present invention has a large tolerable range for the variance of the surface status of the image bearing member, particularly the presence of a low resistant portion, and has a structure which highly reduces the variance in the charge control performance of the image bearing member. Therefore, extremely high quality images are stably formed by using a combination of the image forming apparatus and the toner having the composition described above over a long period of time.

In addition, the image forming apparatus of the present invention can be used for not only the polymerization toner having a suitable structure to obtain quality images but also pulverization toner having irregular forms. Also, the working life of the image forming apparatus is significantly elongated even when such pulverization toner having irregular forms is used. There is no specific limit to selection of material forming such pulverization toner as long as it can be used in electrophotography.

Specific examples of the binder resins for use in the toner include, but are not limited to, styrene polymers and substituted styrene homopolymers such as poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; homopolymers of acrylic esters or copolymers thereof such as polymethyl acrylate, polybutyl acrylate, polymethyl methacrylate, and polybutyl methacrylate; polyvinyl derivatives such as polyvinyl chloride and polyvinyl acetate; polyester-based polymers, polyurethane based polymers, polyamide based polymers, polyimide based polymers, polyol based polymers, epoxy based polymers, terpene based polymers, aliphatic or alicyclic hydro carbon resins and aromatic oil resins. These can be used alone or in combination. Among these, styrene-acrylic based copolymers, polyester based resins, polyol based resins, and mixtures thereof are more preferable in terms of electric characteristics and cost. polyester based resins and polyol based resins are furthermore preferably used in terms of the fixing characteristics.

The pulverization toner is manufactured by: preliminarily mixing these resin components with the coloring agent component, the wax component, the charge control components, if desired; mixing and kneading them at a temperature around the melting point of the resin component; and cooling down the mixture followed by pulverization and classification process. The external additive specified above can be optionally admixed with the toner.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified

EXAMPLES

Next, the present disclosure is described in detail with reference to Examples but not limited thereto.

Example 1

1. Manufacturing of Protective Agent Block

The protective agent block of the present disclosure is manufactured according to the following procedures.

Particulating Process

Weigh a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 9:1:0.5 (weight ratio), mix them by a blender for six seconds followed by a suspension of 30 seconds. Repeat this operation three times to obtain a powder mixture. free-fall the powder mixture from above to the pressing roller illustrated in FIG. 3 to manufacture protective agent particles having an average particle diameter of 54 μm. The average particle diameter is measured by a laser diffraction particle size analyzer (SALD-3100/2200, manufactured by Shimadzu Corporation). Observe the manufactured protective agent particulates by an electron microscope according to scanning electron microscopy (SEM) to find that the particles have melted forms in which flat particles are stack. Sample the manufactured particles in 10 capillaries made of glass and measure Raman spectra thereof. The Raman spectra are measured by Raman spectroscopic analyzer (Raman 950, manufactured by ThermoNicolet.Japan), with a laser power of 1.0 A. Calculate the weight ratio Mr from the Relationship 1 using the ratio (ABN/ASP) of the peak area ABN in the range of from a wavenumber of 1377.837 $cm^{-1}$ to 1354.695 $cm^{-1}$ to the peak area ASP in the range of from a wavenumber of 1481.012 $cm^{-1}$ to 1420.264 $cm^{-1}$ based on the measured Raman spectra using OMNIC software (manufactured by ThermoScientific Co., Ltd.). The results are that the average of the weight ratios Mr is 0.097 and the variation coefficient is 0.030.

Compacting Process

Place the manufactured protective agent particles having an average particle diameter of 54 μm in a compacting cast and compact them by a pressing machine until the thickness becomes corresponding to a true density of 65% followed by 10 seconds of suspension. Compact the particles again until the thickness becomes corresponding to a true specific gravity of 92% to obtain four protective agent blocks having a width of 8 mm, a thickness of 18.1 mm, and a length of 322 mm. Measure Raman spectra of the surface of each of the manufactured protective agent block for 20 points with a gap of 10 mm therebetween along the longitudinal direction starting at 66 mm from the end of the surface. The Raman spectra are measured by a Raman spectroscopic analyzer (Raman 950, manufactured by ThermoNicolet.Japan) in which the sample room is remodeled to directly measure the protective agent block with a laser power of 1.0 W. The irradiation area of the laser beam has a diameter of about 1 mm. Calculate the weight ratio Mr from the Relationship 1 using the ratio (ABN/ASP) of the peak area ABN in the range of from a wavenumber of 1377.837 $cm^{-1}$ to 1354.695 $cm^{-1}$ to the peak area ASP in the range of from a wavenumber of 1481.012 $cm^{-1}$ to 1420.264 $cm^{-1}$ based on the measured Raman spectra using OMNIC software (manufactured by ThermoScientific Co., Ltd.). The results are that the average of the weight ratios Mr is 0.098 and the variation coefficient is 0.036.

2. Evaluation of Protective Agent Block

Install the four protective agent blocks onto the protective agent applicators of respective image formation stations of a tandem type color image forming apparatus (imagio MPC 4500, manufactured by Ricoh Co., Ltd.) and continue image forming on 20,000 A4 portrait size sheets. ISO test chart (refer to http:www.iso.org/jtc1/sc28) is used as the output chart for evaluation. Resultantly, a quality image is obtained on 20,000th paper.

Example 2

The protective agent block of Example 2 is manufactured in the same manner as in Example 1 except that the powder used in the particulating process is changed to a mixture (71:29 in weight ratio) having an average particle diameter of 85 μm of zinc stearate and zinc palmitate, hexagonal boron nitride having a primary average particle diameter of 0.20 μm, and spherical alumina having an average particle diameter of 0.29 μm. Protective agent particles having an average particle diameter of 292 μm are obtained in the particulating process. In addition, according to the Raman spectra measuring results of the obtained protective agent particles, the average of the weight ratios Mr calculated from the relationship 1 is 0.111 with a variation coefficient of 0.070(0.075). Thereafter, protective agent blocks having a thickness of 18.5 mm are obtained in the compacting process. In addition, according to the Raman spectra measuring results of the obtained protective agent blocks, the average of the weight ratios Mr calculated from the relationship 1 is 0.108 with a variation coefficient of 0.073. In addition, as a result of the continuous image forming test in the tandem type color image forming apparatus using the four protective agent blocks, slight streaks are noticed in the 20,000th image by staring but cause no practical problems.

Example 3

The protective agent block of Example 3 is manufactured in the same manner as in Example 1 except that the powder used in the particulating process is changed to a mixture (69:31 in weight ratio) having an average particle diameter of 35 μm of zinc stearate and zinc palmitate, hexagonal boron nitride having a primary average particle diameter of 0.15 μm, and spherical alumina having an average particle diameter of 0.29 μm. Protective agent particles having an average particle diameter of 110 μm are obtained in the particulating process. In addition, according to the Raman spectra measuring results of the obtained protective agent particles, the average of the weight ratios Mr calculated from the relationship 1 is 0.103 with a variation coefficient of 0.052. Thereafter, protective agent blocks having a thickness of 15.2 mm are obtained in the compacting process. In addition, according to the Raman spectra measuring results of the obtained protective agent blocks, the average of the weight ratios Mr calculated from the relationship 1 is 0.103 with a variation coefficient of 0.055. In addition, as a result of the continuous image forming test in the tandem type color image forming apparatus using the four protective agent blocks, an extremely quality image is printed on the 20,000th paper.

Example 4

The protective agent block of Example 4 is manufactured in the same manner as in Example 1 except that the powder used in the particulating process is changed to a mixture having an average particle diameter of 25 μm of zinc stearate and zinc palmitate, hexagonal boron nitride having a primary average particle diameter of 0.17 μm, and spherical alumina having an average particle diameter of 0.29 μm. Protective agent particles having an average particle diameter of 73 μm are obtained in the particulating process. In addition, according to the Raman spectra measuring results of the obtained protective agent particles, the average of the weight ratios Mr calculated from the relationship 1 is 0.097 with a variation coefficient of 0.044. Thereafter, protective agent blocks having a thickness of 24.3 mm are obtained in the compacting process. In addition, according to the Raman spectra measuring results of the obtained protective agent blocks, the average of the weight ratios Mr calculated from the relationship 1 is 0.098 with a variation coefficient of 0.049. In addition, as a result of the continuous image forming test in the tandem type color image forming apparatus using the four protective agent blocks, an extremely quality image is printed on the 20,000th paper.

Example 5

The protective agent block of Example 7 is manufactured in the same manner as in Example 1 except that the powder used in the particulating process is changed to a mixture (72:28 in weight ratio) having an average particle diameter of 13 μm of zinc stearate and zinc palmitate, hexagonal boron nitride having a primary average particle diameter of 0.17 μm, and spherical alumina having an average particle diameter of 0.29 μm. Protective agent particles having an average particle diameter of 31 μm are obtained in the particulating process. In addition, according to the Raman spectra measuring results of the obtained protective agent particles, the average of the weight ratios Mr calculated from the relationship 1 is 0.098 with a variation coefficient of 0.065. Thereafter, protective agent blocks having a thickness of 20.2 mm are obtained in the compacting process. In addition, according to the Raman spectra measuring results of the obtained protective agent blocks, the average of the weight ratios Mr calculated from the relationship 1 is 0.098 with a variation coefficient of 0.062. In addition, as a result of the continuous image forming test in the tandem type color image forming apparatus using the four protective agent blocks, an extremely quality image is printed on the 20,000th paper.

Example 6

The protective agent block of Example 6 is manufactured in the same manner as in Example 1 except that the powder used in the particulating process is changed to a mixture (72:28 in weight ratio) having an average particle diameter of 20 μm of zinc stearate and zinc palmitate, hexagonal boron nitride having a primary average particle diameter of 0.17 μm, and spherical alumina having an average particle diameter of 0.29 μm. Protective agent particles having an average particle diameter of 65 μm are obtained in the particulating process. In addition, according to the Raman spectra measuring results of the obtained protective agent particles, the average of the weight ratios Mr calculated from the relationship 1 is 0.099 with a variation coefficient of 0.037. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.099 with a variation coefficient of 0.035. In addition, as a result of the continuous image forming test in the tandem type color image forming apparatus using the four protective agent blocks, an extremely quality image is printed on the 20,000th paper.

Example 7

The protective agent block of Example 7 is manufactured in the same manner as in Example 1 except that the powder used in the particulating process is changed to a mixture (72:28 in weight ratio) having an average particle diameter of 22 μm of zinc stearate and zinc palmitate, hexagonal boron nitride having a primary average particle diameter of 0.17 μm, and spherical alumina having an average particle diameter of 0.29 μm. Protective agent particles having an average particle diameter of 68 μm are obtained in the particulating process. In addition, according to the Raman spectra measuring results of the obtained protective agent particles, the average of the weight ratios Mr calculated from the relationship 1 is 0.099 with a variation coefficient of 0.033. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.099 with a variation coefficient of 0.037. In addition, as a result of the continuous image forming test in the tandem type color image forming apparatus using the four protective agent blocks, an extremely quality image is printed on the 20,000th paper.

Example 8

The protective agent block of Example 8 is manufactured in the same manner as in Example 1 except that the powder used in the particulating process is changed to a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 95:5:0.5 (weight ratio). Protective agent particles having an average particle diameter of 54 μm are obtained in the particulating process. In addition, according to the Raman spectra measuring results of the obtained protective agent particles, the average of the weight ratios Mr calculated from the relationship 1 is 0.051 with a variation coefficient of 0.070(0.075). Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.051 with a variation coefficient of 0.075. In addition, as a result of the continuous image forming test in the tandem type color image forming apparatus using the four protective agent blocks, slight streaks are noticed in the 20,000th image by staring but cause no practical problems.

Example 9

The protective agent block of Example 9 is manufactured in the same manner as in Example 1 except that the powder used in the particulating process is changed to a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 93:7:0.5 (weight ratio). Protective agent particles having an average particle diameter of 56 μm are obtained in the particulating process. In addition, according to the Raman spectra measuring results of the obtained protective agent particles, the average of the weight ratios Mr calculated from the relationship 1 is 0.073 with a variation coefficient of 0.052. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.072 with a variation coefficient of 0.056. In addition, as a result of the continuous image forming test in the tandem type color image forming apparatus using the four protective agent blocks, an extremely quality image is printed on the 20,000th paper.

Example 10

The protective agent block of Example 10 is manufactured in the same manner as in Example 1 except that the powder used in the particulating process is changed to a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 81:19:0.5 (weight ratio). Protective agent particles having an average particle diameter of 53 μm are obtained in the particulating process. In addition, according to the Raman spectra measuring results of the obtained protective agent particles, the average of the weight ratios Mr calculated from the relationship 1 is 0.232 with a variation coefficient of 0.044. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.234 with a variation coefficient of 0.049. In addition, as a result of the continuous image forming test in the tandem type color image forming apparatus using the four protective agent blocks, an extremely quality image is printed on the 20,000th paper.

Example 11

The protective agent block of Example 11 is manufactured in the same manner as in Example 1 except that the powder used in the particulating process is changed to a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 85:15:0.5 (weight ratio). Protective agent particles having an average particle diameter of 52 μm are obtained in the particulating process. In addition, according to the Raman spectra measuring results of the obtained protective agent particles, the average of the weight ratios Mr calculated from the relationship 1 is 0.176 with a variation coefficient of 0.032. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.175 with a variation coefficient of 0.037. In addition, as a result of the continuous image forming test in the tandem type color image forming apparatus using the four protective agent blocks, an extremely quality image is printed on the 20,000th paper.

Example 12

The protective agent block of Example 12 is manufactured in the same manner as in Example 1 except that the powder used in the particulating process is changed to a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 79:21:0.5 (weight ratio). Protective agent particles having an average particle diameter of 53 μm are obtained in the particulating process. In addition, according to the Raman spectra measuring results of the obtained protective agent particles, the average of the weight ratios Mr calculated from the relationship 1 is 0.265 with a variation coefficient of 0.041. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.266 with a variation coefficient of 0.044. In addition, as a result of the continuous image forming test in the tandem type color image forming apparatus using the four protective agent blocks, an extremely quality image is printed on the 20,000th paper.

Example 13

The protective agent block of Example 13 is manufactured in the same manner as in Example 1 except that the powder used in the particulating process is changed to a mixture (65:35 in weight ratio) having an average particle diameter of 18 μm of zinc stearate and zinc palmitate, hexagonal boron nitride having a primary average particle diameter of 0.15 μm, and spherical alumina having an average particle diameter of 0.27 μm in a ratio of 76:24:0.5 (weight ratio). Protective agent particles having an average particle diameter of 53 μm are obtained in the particulating process. In addition, according to the Raman spectra measuring results of the obtained protective agent particles, the average of the weight ratios Mr calculated from the relationship 1 is 0.314 with a variation coefficient of 0.069. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.314 with a variation coefficient of 0.072. In addition, as a result of the continuous image forming test in the tandem type color image forming apparatus using the four protective agent blocks, slight streaks are noticed in the 20,000th image by staring but cause no practical problems.

Comparative Example 1

1. Manufacturing of Protective Agent Block

Four protective agent blocks having a width of 8 mm, a thickness of 18.1 mm, and a length of 322 mm are manufactured by melting and fusing a mixture (65:35 in weight ratio) having an average particle diameter of 3 μm of zinc stearate and zinc palmitate followed by cooling down.

2. Evaluation of Protective Agent Block

As a result of the continuous image forming test in the tandem type color image forming apparatus using the manufactured four protective agent blocks, many streaks are observed in the 20,000th image.

Comparative Example 2

The protective agent block of Comparative Example 2 is manufactured in the same manner as in Example 1 except that the powder used in the particulating process is changed to a mixture (72:28 in weight ratio) having an average particle diameter of 22 μm of zinc stearate and zinc palmitate and spherical alumina having an average particle diameter of 0.29 gm in a weight ratio of 9:0.5. Protective agent particles having an average particle diameter of 65 μm are obtained in the particulating process. In addition, according to the Raman spectra measuring results of the obtained protective agent particles, the average of the weight ratios Mr calculated from the relationship 1 is 0.000. Thereafter, protective agent blocks having a thickness of 17.2 mm are obtained in the compacting process. In addition, according to the Raman spectra measuring results of the obtained protective blocks, the average of the weight ratios Mr calculated from the relationship 1 is 0.000. As a result of the continuous image forming test in the tandem type color image forming apparatus using the manufactured four protective agent blocks, many streaks are observed in the 20,000th image.

Comparative Example 3

Weigh a powder mixture (65:35) for use in the particulating process, i.e., a mixture of mizinc stearate having an average particle diameter of 18 μm and zinc palmitate, hexagonal boron nitride having a primary average particle diameter of 0.15 μm, and spherical alumina having an average particle diameter of 0.27 μm in a ratio of 9:1:0.5 (weight ratio), mix them by a blender for six seconds followed by a suspension of 30 seconds. Repeat this operation three times and melt and fuse the powder mixture by heating followed by cooling down to obtain a protective agent block having a thickness of 17.2 mm. According to the Raman spectra measuring results of the obtained protective agent blocks, the average of the weight ratios Mr calculated from the relationship 1 is 0.090 with a variation coefficient of 0.076. As a result of the continuous image forming test in the tandem type color image forming apparatus using the manufactured four protective agent blocks, many streaks are observed in the 20,000th image.

Comparative Example 4

Weigh a powder mixture (65:35) for use in the particulating process, i.e., a mixture of mizinc stearate having an average particle diameter of 18 μm and zinc palmitate, hexagonal boron nitride having a primary average particle diameter of 0.15 μm, and spherical alumina having an average particle diameter of 0.27 μm in a ratio of 9:1:0.5 (weight ratio), mix them by a blender for six seconds followed by a suspension of 30 seconds. Repeat this operation three times to obtain a powder mixture. According to the Raman spectra measuring results of the obtained protective agent particles, the average of the weight ratios Mr calculated from the relationship 1 is 0.110 with a variation coefficient of 0.050. Thereafter, protective agent blocks having a thickness of 17.2 mm are obtained in the compacting process. In addition, according to the Raman spectra measuring results of the obtained protective agent blocks, the average of the weight ratios Mr calculated from the relationship 1 is 0.103 with a variation coefficient of 0.119. As a result of the continuous image forming test in the tandem type color image forming apparatus using the manufactured four protective agent blocks, many streaks are observed in the 20,000th image. The results of Examples and Comparative Examples are shown in Tables 1 and 2.

TABLE 1

| | Raw material (powder) *1 | | | | | | |
|---|---|---|---|---|---|---|---|
| | Metal soap | | Boron nitride | alumina | Protective agent particle | | |
| | | | | | | Weight ration Mr | |
| | S:P *2 | Average particle diameter (μm) | Primary particle diameter (μm) | Average particle diameter (μm) | Average particle diameter (μm) | Average | Variation coefficient |
| Example 1 | 65:35 | 18 | 0.15 | 0.27 | 54 | 0.097 | 0.030 |
| Example 2 | 71:29 | 85 | 0.20 | 0.29 | 292 | 0.111 | 0.070 |
| Example 3 | 69:31 | 35 | 0.15 | 0.29 | 110 | 0.103 | 0.052 |
| Example 4 | 100:0 | 25 | 0.17 | 0.29 | 73 | 0.097 | 0.044 |
| Example 5 | 72:28 | 13 | 0.17 | 0.29 | 31 | 0.098 | 0.065 |
| Example 6 | 72:28 | 20 | 0.17 | 0.29 | 65 | 0.099 | 0.037 |
| Example 7 | 72:28 | 22 | 0.17 | 0.29 | 68 | 0.099 | 0.033 |
| Comparative Example 1 | 65:35 | 3 | — | — | — | — | — |
| Comparative Example 2 | 72:28 | 22 | — | 0.29 | 65 | 0.000 | — |
| Comparative Example 3 | 65:35 | 18 | 0.15 | 0.27 | — | — | — |
| Comparative Example 4 | 65:35 | 18 | 0.15 | 0.27 | mixture only | 0.110 | 0.050 |

| | Protective agent Block | | | |
|---|---|---|---|---|
| | | Weight ratio Mr | | |
| | Thickness (mm) | Average | Variation coefficient | Image evaluation *3 |
| Example 1 | 18.1 | 0.098 | 0.036 | G |
| Example 2 | 18.5 | 0.108 | 0.073 | F |
| Example 3 | 15.2 | 0.103 | 0.055 | G |
| Example 4 | 24.3 | 0.098 | 0.049 | G |
| Example 5 | 20.2 | 0.098 | 0.062 | G |
| Example 6 | 17.2 | 0.099 | 0.035 | G |
| Example 7 | 17.2 | 0.099 | 0.037 | G |
| Comparative Example 1 | 18.1 | — | — | B |
| Comparative Example 2 | 17.2 | 0.000 | — | B |
| Comparative Example 3 | 18.1 | 0.090 | 0.076 | B |
| Comparative Example 4 | 17.2 | 0.103 | 0.119 | B |

*1: Metal soap:Boron nitride:Alumina = 9:1:0.5 (weight ratio)

*2: Zinc stearate (S):Zinc palmitate (P) (weight ratio)

*3: G (good): Excellent quality

F (fair): No practical problem (slight streaks observed by staring)

B (bad): Defective images with streaks

TABLE 2

| | Raw material (powder) *1 | Protective agent particle | | | | Protective agent block | | |
|---|---|---|---|---|---|---|---|---|
| | Mixing ratio (weight ratio) (metal soap:boron nitride:alumina) | Average particle diameter (μm) | Weight ratio Mr Average | Weight ratio Mr Variation coefficient | Thickness (mm) | Weight ratio Mr Average | Weight ratio Mr Variation coefficient | Image evaluation *2 |
| Example 8 | 95:5:0.5 | 54 | 0.051 | 0.070 | 17.2 | 0.051 | 0.075 | F |
| Example 9 | 93:7:0.5 | 56 | 0.073 | 0.052 | 17.2 | 0.072 | 0.056 | G |
| Example 10 | 81:19:0.5 | 53 | 0.232 | 0.044 | 17.2 | 0.234 | 0.049 | G |
| Example 11 | 85:15:0.5 | 54 | 0.176 | 0.032 | 17.2 | 0.175 | 0.037 | G |
| Example 12 | 79:21:0.5 | 53 | 0.265 | 0.041 | 17.2 | 0.266 | 0.044 | G |
| Example 13 | 16:24:0.5 | 53 | 0.314 | 0.069 | 17.2 | 0.314 | 0.072 | F |

*1: Metal soap (zinc stearate:zinc palmitate (weight ratio) = 65:35, average particle diameter: 18 μm):boron nitride:(hexagonal, average primary particle diameter: 0.15 μm):alumina (spherical alumina having an average particle diameter of 0.27 μm)
*2: G (good): Excellent quality
F (fair): No practical problem (slight streaks observed by staring)
B (bad): Defective images with streaks

Example 14

The protective agent block of Example 14 is manufactured in the same manner as in Example 1 except that zinc stearate having an average particle diameter of 18 μm and zinc palmitate having an average particle diameter of 16 μm, hexagonal boron nitride having a primary average particle diameter of 0.21 μm, and spherical alumina having an average particle diameter of 0.22 μm are weighed in a ratio of 85:15:0.5 (weight ratio) in the particulatng process instead. Protective agent particles having an average particle diameter of 55 μm are obtained in the particulating process. In addition, according to the Raman spectra measuring results of the obtained protective agent particles, the average of the weight ratios Mr calculated from the relationship 1 is 0.177 with a variation coefficient of 0.037. Thereafter, protective agent blocks having a thickness of 19 mm are obtained in the compacting process. In addition, according to the Raman spectra measuring results of the obtained protective agent blocks, the average of the weight ratios Mr calculated from the relationship 1 is 0.175 with a variation coefficient of 0.033. A continuous image forming test in the tandem type color image forming apparatus using the manufactured four protective agent blocks is conducted at 20° C. Resultantly, a quality image is obtained on 20,000th paper.

Example 15

The protective agent block of Example 15 is manufactured in the same manner as in Example 14 except that a mixture (65:35 in weight ratio) having an average particle diameter of 21 μm of zinc stearate and zinc palmitate is used instead of zinc stearate having an average particle diameter of 18 μm and zinc palmitate having an average particle diameter of 16 μm (65:35 in weight ratio). Protective agent particles having an average particle diameter of 54 μm are obtained in the particulating process. In addition, according to the Raman spectra measuring results of the obtained protective agent particles, the average of the weight ratios Mr calculated from the relationship 1 is 0.176 with a variation coefficient of 0.035. Thereafter, protective agent blocks having a thickness of 18 mm are obtained in the compacting process. In addition, according to the Raman spectra measuring results of the obtained protective agent blocks, the average of the weight ratios Mr calculated from the relationship 1 is 0.175 with a variation coefficient of 0.036. A continuous image forming test in the tandem type color image forming apparatus using the manufactured four protective agent blocks is conducted at 20° C. Resultantly, a quality image is obtained on 20,000th paper.

Comparative Example 5

The protective agent block of Comparative Example 5 is manufactured in the same manner as in Example 14 except that a mixture (65:35 in weight ratio) having an average particle diameter of 120 μm of zinc stearate and zinc palmitate is used instead of zinc stearate having an average particle diameter of 18 μm and zinc palmitate having an average particle diameter of 16 μm (65:35 in weight ratio). Protective agent particles having an average particle diameter of 320 μm are obtained in the particulating process. In addition, according to the Raman spectra measuring results of the obtained protective agent particles, the average of the weight ratios Mr calculated from the relationship 1 is 0.176 with a variation coefficient of 0.88. Thereafter, protective agent blocks having a thickness of 19 mm are obtained in the compacting process. In addition, according to the Raman spectra measuring results of the obtained protective agent blocks, the average of the weight ratios Mr calculated from the relationship 1 is 0.175 with a variation coefficient of 0.090. A continuous image forming test in the tandem type color image forming apparatus using the manufactured four protective agent blocks is conducted at 20° C. Streaks are observed in the 20,000th image. By checking the protective agent block, how the protective agent block is scraped is greatly different depending on the portion and the protective agent block corresponding to the streaks has already disappeared.

Example 16

The protective agent block of Example 16 is manufactured in the same manner as in Example 15 except that the mixing ratio of zinc stearate having an average particle diameter of 18 μm and zinc palmitate having an average particle diameter of 16 μm, hexagonal boron nitride having a primary average particle diameter of 0.21 μm, and spherical alumina having an average particle diameter of 0.22 μm is changed to a ratio of 80:20:0.5. Protective agent particles having an average particle diameter of 55 μm are obtained in the particulating process. In addition, according to the Raman spectra measuring results of the obtained protective agent particles, the average of the weight ratios Mr calculated from the relationship 1 is 0.250 with a variation coefficient of 0.038. Thereafter, protective agent blocks having a thickness of 19.5 mm are obtained in the compacting process. In addition, according to the Raman spectra measuring results of the obtained protective agent blocks, the average of the weight ratios Mr calculated from the relationship 1 is 0.251 with a variation coefficient of 0.035. A continuous image forming test in the tandem type color image forming apparatus using the manufactured four protective agent blocks is conducted at 18° C. Resultantly, a quality image is obtained on 20,000th paper.

Comparative Example 6

The protective agent block of Comparative Example 6 is manufactured in the same manner as in Example 14 except that a mixture (65:35 in weight ratio) having an average particle diameter of 120 μm of zinc stearate and zinc palmitate is used instead of a mixture (65:35 in weight ratio) having an average particle diameter of 21 μm of zinc stearate and zinc palmitate is used instead of zinc stearate having an average particle diameter of 18 μm in Example 15.

Protective agent particles having an average particle diameter of 325 μm are obtained in the particulating process. In addition, according to the Raman spectra measuring results of the obtained protective agent particles, the average of the weight ratios Mr calculated from the relationship 1 is 0.253 with a variation coefficient of 0.91. Thereafter, protective agent blocks having a thickness of 19.5 mm are obtained in the compacting process. In addition, according to the Raman spectra measuring results of the obtained protective agent blocks, the average of the weight ratios Mr calculated from the relationship 1 is 0.250 with a variation coefficient of 0.096. A continuous image forming test in the tandem type color image forming apparatus using the manufactured four protective agent blocks is conducted at 18° C. Streaks are observed in the 20,000th image. By checking the protective agent block, how the protective agent block is scraped is greatly different depending on the portion and the protective agent block corresponding to the streaks has already disappeared.

What is claimed is:

1. A protective agent block manufactured by a method comprising:

particulating a mixture comprising metal soap and boron nitride to obtain protective agent particles having an average particle diameter of from 30 μm to 300 μm comprising the metal soap and boron nitride; and compacting the protective agent particles to obtain the protective agent block.

2. The protective agent block according to claim 1, wherein the metal soap is at least one of zinc stearate and zinc palmitate.

3. A protective agent block comprising:

metal soap; and boron nitride, wherein a weight ratio Mr of boron nitride to the metal soap is calculated from the relationship 1 based on Raman spectrum measured at each of multiple places on the protective agent block and an average of the measured weight ratios Mr ranges from 0.050 to 0.330 with a variation coefficient of 0.075 or less:

$$Mr=(\log(ABN/ASP)+1.3588)/7.7374 \quad \text{Relationship 1}$$

where ABN represents a peak area in a range of from a wavenumber of 1377.837 $cm^{-1}$ to 1354.695 $cm^{-1}$ and ASP represents a peak area in a range of from a wavenumber of 1481.012 $cm^{-1}$ to 1420.264 $cm^{-1}$.

4. The protective agent block according to claim 3, wherein the Raman spectrum is obtained at each of multiple places situated along a longitudinal direction of the protective agent block.

5. The protective agent block according to claim 3, wherein the metal soap is at least one of zinc stearate and zinc palmitate.

6. A process cartridge comprising:

a process agent application applicator having the protective agent block of claim 3.

7. An image forming apparatus comprising:

a process agent application applicator having the protective agent block of claim 3.

8. An image forming apparatus comprising:

multiple image forming stations to form a color image by superimposing multiple color images, wherein one of the multiple image forming stations comprises a process agent application applicator having the protective agent block of claim 3.

* * * * *